US007703878B2

(12) United States Patent
Koase

(10) Patent No.: US 7,703,878 B2
(45) Date of Patent: Apr. 27, 2010

(54) LIQUID DISCHARGING APPARATUS AND METHOD FOR DETECTING MALFUNCTIONING NOZZLES ON THE BASIS OF IMAGE DATA

(75) Inventor: Takashi Koase, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 234 days.

(21) Appl. No.: 11/754,012

(22) Filed: May 25, 2007

(65) Prior Publication Data

US 2008/0018691 A1 Jan. 24, 2008

(30) Foreign Application Priority Data

May 26, 2006 (JP) ..... 2006-146989
May 7, 2007 (JP) ..... 2007-122612

(51) Int. Cl.
*B41J 2/165* (2006.01)
*B41J 29/393* (2006.01)
*B41J 2/155* (2006.01)
*B41J 2/15* (2006.01)

(52) U.S. Cl. ..... 347/23; 347/19; 347/32; 347/37; 347/40

(58) Field of Classification Search ..... 347/19
See application file for complete search history.

(56) References Cited

U.S. PATENT DOCUMENTS 5,040,000 A * 8/1991 Yokoi ..... 347/30
5,051,761 A * 9/1991 Fisher et al. ..... 347/30
2002/0149641 A1* 10/2002 Du et al. ..... 347/23
2003/0214659 A1* 11/2003 Niimura ..... 358/1.8
2004/0179080 A1* 9/2004 Hasebe et al. ..... 347/102
2005/0030327 A1* 2/2005 Tatsumi ..... 347/13
2005/0162452 A1* 7/2005 Kachi ..... 347/13

FOREIGN PATENT DOCUMENTS

JP 2002-361863 12/2002
JP 2004-299140 10/2004

* cited by examiner

*Primary Examiner*—Matthew Luu
*Assistant Examiner*—Shelby Fidler
(74) *Attorney, Agent, or Firm*—Workman Nydegger

(57) ABSTRACT

To shorten time for an abnormal discharge test and time for cleaning; and to reduce the amount of drain ink used at the time of the abnormal discharge test and the cleaning. A liquid drop discharging apparatus comprising: a plurality of nozzles that discharge liquid drops; a sensor that detects a malfunctioning nozzle at which abnormal discharge occurs when the liquid drop is supposed to be discharged therefrom; and a controller that determines whether the liquid drop is discharged or not from each of the nozzles on the basis of image data, the controller causing the sensor to detect the malfunctioning nozzle among the nozzles that are determined to discharge the liquid drops on the basis of the image data.

11 Claims, 15 Drawing Sheets

LIQUID DISCHARGING APPARATUS AND METHOD FOR DETECTING MALFUNCTIONING NOZZLES ON THE BASIS OF IMAGE DATA

TECHNICAL FIELD

The present invention relates to a liquid drop discharging apparatus and a liquid discharging method.

BACKGROUND ART

An ink-jet printer is a known example of a liquid discharging apparatus that discharges ink onto various kinds of target objects such as a sheet of paper, cloth, film, and so on to perform printing. An ink-jet printer discharges ink through its nozzles to form dots on a target object for printing.

In such an ink-jet printer, an abnormal discharge phenomenon, in which ink is not discharged properly as it is supposed to be, could occur sometimes due to the clogging of its nozzle (s), which is caused by the thickening of ink, the adhesion of dust, among other reasons. Therefore, it is necessary to conduct periodical inspection of the operating conditions of nozzles to detect any abnormal discharge so as to check whether ink is discharged properly or not. Various kinds of abnormal discharge detection methods have been proposed to date. As an example thereof, an optical detection is carried out to check whether ink discharged from a nozzle shuts off a laser beam or not so as to recognize the presence/absence of properly discharged ink. (refer to Patent Document 1)

Cleaning is performed when any nozzle at which abnormal discharge occurs is detected. Such a malfunctioning nozzle will discharge ink properly after cleaning. Flushing and pump suction are known as typical examples of cleaning methods. (refer to Patent Document 2)

(Patent Document 1) Japanese Unexamined Patent Application Publication No. 2002-361863

(Patent Document 2) Japanese Unexamined Patent Application Publication No. 2004-299140

DISCLOSURE OF THE INVENTION

It takes proportionately long time for inspection if it is assumed that all nozzles of an ink-jet printer are to be subjected to an abnormal discharge test. In addition thereto, extra ink is consumed for inspection. Cleaning operations are conducted when any malfunctioning nozzle is detected in the abnormal discharge test. This means that it takes time, involving consumption of ink, for cleaning.

In order to address such a problem, the present invention aims to shorten time that is required for an abnormal discharge test and cleaning.

A liquid drop discharging apparatus includes: a plurality of nozzles that discharge liquid drops; a sensor that detects a malfunctioning nozzle at which abnormal discharge occurs when a liquid drop is supposed to be discharged therefrom; and a controller that determines whether a liquid drop is discharged or not from each of the nozzles on the basis of image data, the controller causing the sensor to detect the malfunctioning nozzle among the nozzles that are determined to discharge liquid drops on the basis of the image data.

Other features of the present invention will be fully understood by referring to the following detailed description in conjunction with the accompanied drawings.

BEST MODE OF THE INVENTION

Summary of the Disclosure

With reference to the following detailed description in conjunction with the accompanied drawings, at least the following features of the invention will be understood.

A liquid drop discharging apparatus includes: a plurality of nozzles that discharge liquid drops; a sensor that detects a malfunctioning nozzle at which abnormal discharge occurs when a liquid drop is supposed to be discharged therefrom; and a controller that determines whether a liquid drop is discharged or not from each of the nozzles on the basis of image data, the controller causing the sensor to detect the malfunctioning nozzle among the nozzles that are determined to discharge liquid drops on the basis of the image data.

According to such a liquid drop discharging apparatus, an abnormal discharge test is conducted on not all but some of nozzles which discharge liquid drops for completion of image formation (hereafter referred to as active use nozzles, or active nozzles). In comparison with a case where an abnormal discharge test is conducted on all of nozzles, the number of nozzles that are subjected to the abnormal discharge test is reduced according to the invention.

In the liquid drop discharging apparatus according to the above configuration, the sensor tests whether the nozzle is a malfunctioning one or not on a nozzle-by-nozzle basis if the number of the nozzles that are determined to discharge liquid drops on the basis of the image data is more than one.

According to such a liquid drop discharging apparatus, an abnormal discharge test is conducted on a nozzle-by-nozzle basis. Therefore, test time is shorted if the number of nozzles that are subjected to test is small.

In the liquid drop discharging apparatus according to the above configuration, the sensor detects liquid drops discharged from the nozzles.

According to such a liquid drop discharging apparatus, because the test of abnormal discharge is conducted by detecting a liquid drop discharged from the nozzle. Therefore, the amount of liquid drop (ink) that is used for the test is reduced if the number of nozzles that are tested is small.

The liquid drop discharging apparatus according to the above configuration further includes a restoration mechanism used for restoration processing performed on the malfunctioning nozzle so that the restored nozzle discharges ink properly, wherein the controller performs the restoration processing when the sensor detects the malfunctioning nozzle.

According to such a liquid drop discharging apparatus, restoration processing is performed only when there is any malfunctioning nozzle(s) detected among the active use nozzles. Therefore, in comparison with a case where the restoration processing is performed when any malfunctioning nozzle(s) is detected among all of the nozzles, the number of times of restoration executions is reduced according to the invention.

In the liquid drop discharging apparatus according to the above configuration, the restoration processing is a processing to discharge a liquid drop from the malfunctioning nozzle (s).

According to such a liquid drop discharging apparatus, a liquid drop is forcibly discharged from the clogged nozzle so as to unclog the clogged nozzle. Therefore, the amount of liquid drop (ink) that is used for the restoration processing is reduced if the number of times of restoration executions is small.

In the liquid drop discharging apparatus according to the above configuration, the controller performs the restoration processing on the detected malfunctioning nozzle only when the sensor detects the malfunctioning nozzle.

According to such a liquid drop discharging apparatus, the restoration processing is performed only on the malfunctioning nozzle(s) when there is any malfunctioning nozzle(s) detected among the active use nozzles. Therefore, the amount of liquid drop (ink) that is used for the restoration processing is reduced.

The liquid drop discharging apparatus according to the above configuration further includes a transporting mechanism that transports a target object, which liquid drops discharged from the plurality of nozzles land on, in a direction perpendicular to a predetermined direction with respect to a plurality of heads, wherein the plurality of nozzles are provided in the plurality of heads that are arranged in the predetermined direction.

According to such a liquid drop discharging apparatus, abnormal discharge test time is shortened. In addition thereto, liquid drop consumption amount therefor is reduced. Moreover, the number of times of the restoration processing executions as well as liquid drop consumption amount therefor is reduced. Furthermore, among other applications, it can be used for a line head printer.

The liquid drop discharging apparatus according to the above configuration, further includes a transporting mechanism that transports a target object, which liquid drops discharged from the plurality of nozzles land on, in a direction perpendicular to a predetermined direction with respect to a plurality of heads, wherein the plurality of nozzles are provided in the plurality of heads that are arranged in the predetermined direction, and the controller performs the restoration processing on, exclusively, the heads having the detected malfunctioning nozzle when the sensor detects the malfunctioning nozzle.

According to such a liquid drop discharging apparatus, the restoration processing is performed only on head(s) having the malfunctioning nozzle(s) when there is any malfunctioning nozzle(s) detected among the active use nozzles. Therefore, time for the restoration processing is shortened. In addition, the amount of liquid drop (ink) that is used for the restoration processing is reduced.

The liquid drop discharging apparatus according to the above configuration further includes a transporting mechanism that transports a target object, which liquid drops discharged from the plurality of nozzles land on, in a direction perpendicular to a predetermined direction with respect to a plurality of heads, the target object being transported by means of a belt, wherein the plurality of nozzles are provided in the plurality of heads that are arranged in the predetermined direction, and the restoration mechanism is provided at a position where the restoration mechanism can be opposed to nozzle surfaces of the plurality of heads in such a manner that the belt is positioned between the restoration mechanism and the plurality of heads.

According to such a liquid drop discharging apparatus, abnormal discharge test time is shortened. In addition thereto, liquid drop consumption amount therefor is reduced. Moreover, the number of times of the restoration processing executions as well as liquid drop consumption amount therefor is reduced.

In the liquid drop discharging apparatus according to the above configuration, the belt has openings, the number of which is the same as the number of the plurality of heads, and the openings are arranged in such a pattern that, when a certain one of the heads is opposed to corresponding one of the openings, at least one of other heads is not opposed to its corresponding opening.

According to such a liquid drop discharging apparatus, it is possible to perform the abnormal discharge test and the restoration processing while preventing the belt from being stained. In addition, it is also possible to maintain the strength of the belt.

In the liquid drop discharging apparatus according to the above configuration, the belt has openings, the number of which is the same as the number of the plurality of heads, and the openings are arranged in such a pattern that, when a certain one of the heads is opposed to corresponding one of the openings, other heads are also opposed to corresponding openings, respectively.

According to such a liquid drop discharging apparatus, it is possible to perform the abnormal discharge test and the restoration processing while preventing the belt from being stained. In addition, it is not necessary to align the position of the lower surface of the head and the sensor/restoration processing mechanism at each time when the abnormal discharge test/the restoration processing is conducted for a different head. Therefore, it is possible to shorten test time/restoration processing time. Moreover, the restoration processing time is shortened because it is possible to perform the restoration processing for a plurality of heads at the same time.

The liquid drop discharging apparatus according to the above configuration, in which the plurality of nozzles makes up a nozzle line that is arranged in a predetermined direction, the liquid drop discharging apparatus includes: a transporting mechanism that transports a target object, which liquid drops discharged from the nozzles land on, in the predetermined direction with respect to the nozzle line; and a moving mechanism that moves the nozzle line in a direction perpendicular to the predetermined direction with respect to the target object, wherein the operation of the transporting mechanism that transports the target object in the predetermined direction with respect to the nozzle line and the operation of the moving mechanism that moves the nozzle line in the direction perpendicular to the predetermined direction with respect to the target object are conducted in an alternating manner.

According to such a liquid drop discharging apparatus, abnormal discharge test time is shortened. In addition thereto, liquid drop consumption amount therefor is reduced. Moreover, the number of times of the restoration processing executions as well as liquid drop consumption amount therefor is reduced. Furthermore, among other applications, it can be used for a carriage type ink-jet printer (which will be described later).

In addition, it is also possible to embody a liquid drop discharging apparatus comprising: a plurality of heads in which a plurality of nozzles that discharge liquid drops are provided, the plurality of heads being arranged in a predetermined direction; a transporting mechanism that transports a target object, which liquid drops discharged from the plurality of nozzles land on, in a direction perpendicular to the predetermined direction with respect to the plurality of heads, the target object being transported by means of a belt, the belt having openings, the number of which is the same as the number of the plurality of heads, and the openings being arranged in such a pattern that, when a certain one of the heads is opposed to corresponding one of the openings, at least one of other heads is not opposed to its corresponding opening; a sensor that tests whether or not the nozzle is a malfunctioning one at which abnormal discharge occurs when a liquid drop is supposed to be discharged therefrom, the test being conducted by detecting a liquid drop discharged from the nozzle, the sensor conducting a test on a nozzle-by-nozzle basis if the number of the nozzles tested is more than one; a restoration mechanism that is used for restoration processing performed on the malfunctioning nozzle so that the restored nozzle discharges ink properly, the restoration being made by causing the malfunctioning nozzle to discharge a liquid drop, the restoration mechanism being provided at a position where the restoration mechanism can be opposed to nozzle surfaces of the plurality of heads in such a manner that the belt is positioned between the restoration mechanism and the plurality of heads; and a controller that determines whether a liquid drop is discharged or not from each of the nozzles on the basis of image data, the controller causing the sensor to detect the malfunctioning nozzle among the nozzles that are determined to discharge liquid drops on the basis of the image data, the controller performing the restoration processing on the detected malfunctioning nozzle only when the sensor detects the malfunctioning nozzle.

According to such a liquid drop discharging apparatus, the object of the present invention is most effectively accomplished because almost all of the advantageous effects described above can be expected.

A liquid discharging apparatus includes: a plurality of nozzles that discharge liquid drops; a sensor that detects a malfunctioning nozzle at which abnormal discharge occurs; and a controller that determines whether a liquid drop is discharged or not from each of the nozzles on the basis of image data, wherein, when the malfunctioning nozzle is detected by the sensor, the controller causes a liquid drop to be discharged on the basis of the image data if the detected malfunctioning nozzle is the nozzle that is determined not to discharge a liquid drop on the basis of the image data.

According to such a liquid drop discharging apparatus, it is possible to reduce the executions of the restoration processing.

A liquid discharging apparatus according to the above configuration, preferably, further includes a restoration mechanism used for restoration processing performed on the malfunctioning nozzle so that the restored nozzle discharges ink properly, wherein, when a plurality of the malfunctioning nozzles are detected by the sensor, the controller causes the restoration processing to be performed if the detected malfunctioning nozzles are the nozzles that are determined to discharge ink drops on the basis of the image data, whereas the controller causes liquid drops to be discharged on the basis of the image data without carrying out the restoration processing if the detected malfunctioning nozzles are the nozzles that are determined not to discharge liquid drops on the basis of the image data.

According to such a liquid discharging apparatus, it is possible to reduce the executions of the restoration processing while ensuring that a printed image is not affected at all.

In the liquid discharging apparatus according to the above configuration, when the restoration processing is performed, it is preferable that the controller performs the restoration processing on the malfunctioning nozzles that are determined to discharge the liquid on the basis of the image data.

According to such a liquid discharging apparatus, it is possible to shorten the time for the restoration processing.

It is preferable that the liquid discharging apparatus according to the above configuration further includes a transporting mechanism that transports a target object, which liquid drops discharged from the plurality of nozzles land on, in a direction perpendicular to a predetermined direction with respect to a plurality of heads, the target object being transported by means of a belt, wherein the plurality of nozzles are provided in the plurality of heads that are arranged in the predetermined direction, the restoration mechanism is provided at a position where the restoration mechanism can be opposed to the plurality of nozzle surfaces in such a manner that the belt is positioned between the restoration mechanism and the plurality of heads, and the belt has openings, the number of which is the same as the number of the plurality of heads, the openings being arranged in such a pattern that, when a certain one of the heads is opposed to corresponding one of the openings, at least one of other heads is not opposed to its corresponding opening.

By this means, it is possible to maintain the strength of the belt.

It is preferable that the liquid discharging apparatus according to the above configuration further includes a transporting mechanism that transports a target object, which liquid drops discharged from the plurality of nozzles land on, in a direction perpendicular to a predetermined direction with respect to a plurality of heads, the target object being transported by means of a belt, wherein the plurality of nozzles are provided in the plurality of heads that are arranged in the predetermined direction, the restoration mechanism is provided at a position where the restoration mechanism can be opposed to the plurality of nozzle surfaces in such a manner that the belt is positioned between the restoration mechanism and the plurality of heads, and the belt has openings, the number of which is the same as the number of the plurality of heads, the openings being arranged in such a pattern that, when a certain one of the heads is opposed to corresponding one of the openings, other heads are also opposed to corresponding openings, respectively.

By this means, it is possible to shorten the time for the restoration processing.

A liquid discharging method for discharging liquid drops from a plurality of nozzles on the basis of image data, the method comprising: a step of determining whether a liquid drop is discharged or not from each of the nozzles on the basis of the image data; and a step of detecting a malfunctioning nozzle at which abnormal discharge occurs when a liquid drop is supposed to be discharged therefrom among the nozzles that are determined to discharge liquid drops on the basis of the image data.

According to such a liquid drop discharging method, an abnormal discharge test is conducted on a nozzle-by-nozzle basis. Therefore, test time is shorted if the number of nozzles that are subjected to test is small.

A liquid discharging method for discharging liquid drops from a plurality of nozzles on the basis of image data, the method comprising: a step of detecting a malfunctioning nozzle at which abnormal discharge occurs; a step of determining whether a liquid drop is discharged or not from each of the nozzles on the basis of the image data; and a step of discharging a liquid drop on the basis of the image data if the detected malfunctioning nozzle is the nozzle that is determined not to discharge a liquid drop on the basis of the image data when the malfunctioning nozzle is detected.

According to such a liquid discharging method, it is possible to reduce the executions of the restoration processing.

CONFIGURATION OF LINE HEAD PRINTER

Figure 1:
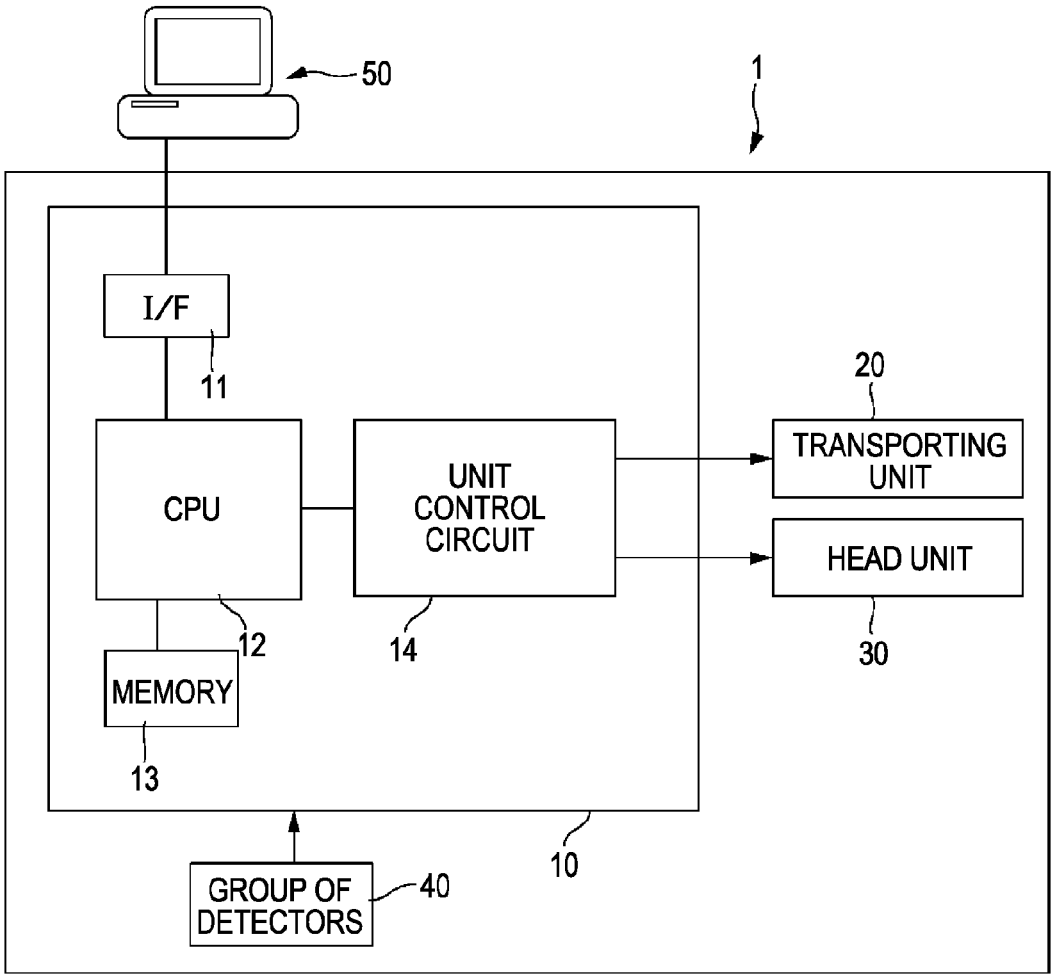
FIG. 1 is a block diagram that illustrates the overall configuration of a printer according to the present embodiment of the invention.
Figure 2:
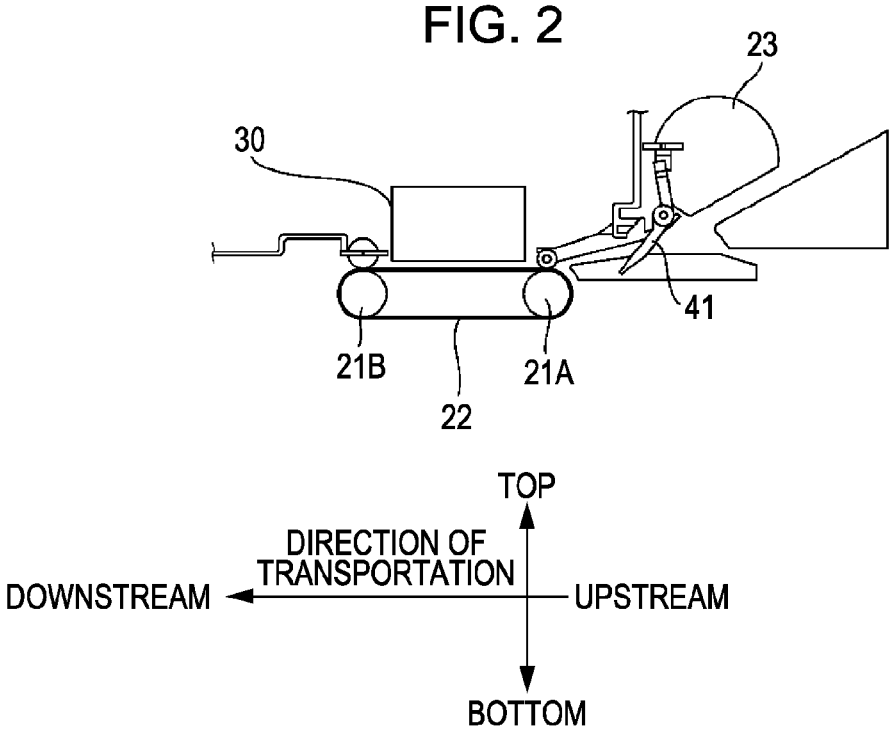
FIG. 2 is a sectional view of the printer.
Figure 3:
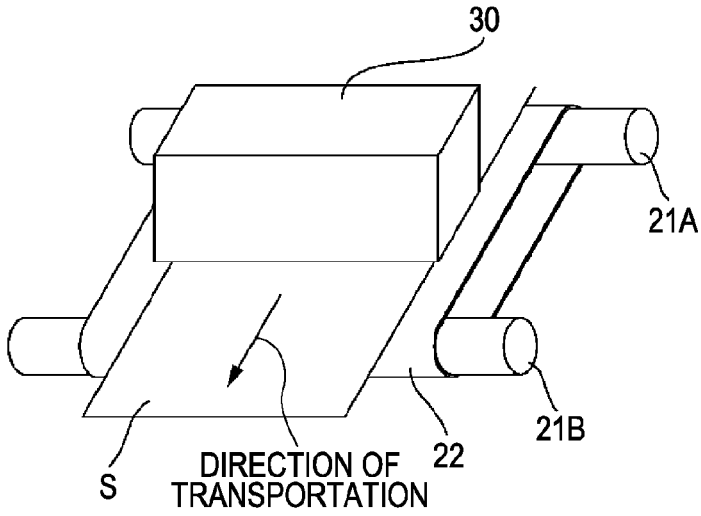
FIG. 3 is a diagram that illustrates the operation of the printer transporting a target object.

FIG. 1 is a block diagram that illustrates the overall configuration of a printer 1 according to the present embodiment of the invention. Herein, the printer 1 is assumed to be a so-called "line head printer", which belongs to the category of ink-jet type printers. FIG. 2 is a sectional view of the printer 1. FIG. 3 is a diagram that illustrates the operation of the printer 1 transporting a target object S (in the following description, this target object is assumed to be a sheet of paper). It is further assumed that the printer 1 performs four-color printing (cyan, magenta, yellow, and black).

The basic configuration of the printer 1, which is a line head printer, is explained below. The printer 1 has a controller 10, a transporting unit 20, a head unit 30, and a group of detectors 40. Upon reception of print data from a computer 50, which is provided as an external device, the printer 1 controls the transporting unit 20 and the head unit 30 through the operation of the controller 10. On the basis of print data received from the computer 50, the controller 10 controls each unit to form an image on the sheet of paper. The group of detectors 40 monitors the status inside the printer 1. The detectors 40 output a detection result to the controller 10. Upon reception of the detection result from the detectors 40, the controller 10 controls each unit on the basis of the detection result.

The controller 10 is a control unit (control section) that controls the printer 1. The controller 10 is provided with an interface section 11, a CPU 12, a memory 13, and a unit control circuit 14. The interface section 11 functions to perform data transmission/reception between the computer 50, which is an external device, and the printer 1. The CPU 12 is a processing unit that controls the printer 1 as a whole. The memory 13 provides a memory area for storing the program of the CPU 12, a work area thereof, and so forth. The memory 13 is constituted by memory devices such as a RAM, EEPROM, and so on. In accordance with the program stored in the memory 13, the CPU 12 controls each unit via a unit control circuit 14.

The transporting unit 20 functions to feed a sheet of paper to a printable position and then transport the paper in a predetermined direction at the time of printing (hereafter referred to as the direction of transportation). As illustrated in FIGS. 2 and 3, the transporting unit 20 is provided with two transporting rollers 21A and 21B, a belt 22, a paper feed roller 23, and a transporting motor (note that the last one is not shown in the drawings). The paper feed roller 23 is a roller that automatically feeds, into the printer 1, the paper that has been inserted into a paper insertion slot. The paper fed by the paper feed roller 23 is then transported by means of a belt conveyor system. The term "belt conveyor system" means a system that transports a target object, which is assumed to be a sheet of paper herein, placed on the annular belt 22 through the mechanical operation thereof, where the belt 22 is rotated by the transporting rollers 21A and 21B. The transporting motor drives the transporting rollers 21A and 21B. The paper is attracted to the belt 22 through an electrostatic chuck or a vacuum chuck (not shown in the drawing).

The head unit 30, which functions to discharge ink onto the paper, has a plurality of heads 31. Each of the plurality of heads has, in turn, a plurality of nozzles 32, which function as ink dischargers. Each of the heads 31 has piezoelectric elements, which function as driving elements, and pressure chambers (not shown in the drawing), the number of which is the same as that of the nozzles. When a piezoelectric element becomes deformed, an elastic membrane (side wall) that partitions a part of the pressure chamber also becomes deformed to discharge ink contained in the pressure chamber through a nozzle. The configuration of the head unit 30 will be described later. In the printer 1, ink is discharged in an intermittent manner from each nozzle without stopping the transportation of the paper. In that way, each nozzle forms a dot column (a raster line) in the direction of transportation to complete the formation of an image.

The group of detectors 40 includes a rotary encoder (not shown in the drawing), a paper detection sensor 41, and so on. The rotary encoder detects the amount of rotation of the transporting rollers 21A and 21B. The paper detection sensor 41 functions to detect the position of the top edge of the paper that is the target object of printing.

Configuration of Head Unit 30

Figure 4:
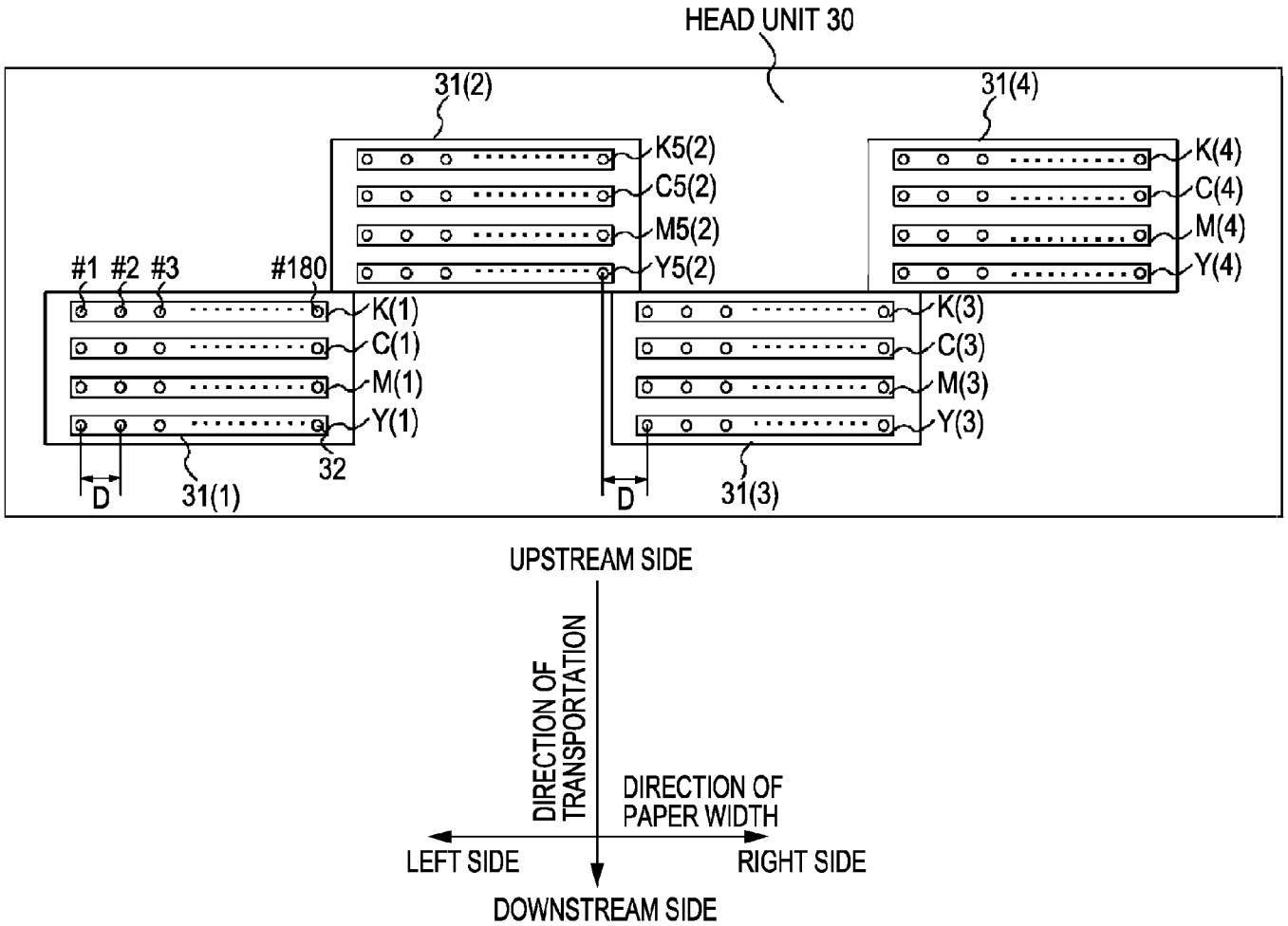
FIG. 4 illustrates a nozzle alignment pattern at the lower surface of a head unit.

FIG. 4 illustrates a nozzle alignment pattern at the lower surface of the head unit 30. The head unit 30 has four heads 31. These four heads 31 are arranged in a staggered pattern along the direction of the width of the paper (i.e., in the direction which is perpendicular to the direction of transportation). Among these heads 31, a head that is relatively closer to the leftmost one when viewed along the direction of the width of the paper is assigned a relatively smaller ordinal number in parenthesis with the leftmost one being the first.

At the lower surface of each of the heads 31, a yellow ink nozzle line Y, a magenta ink nozzle line M, a cyan ink nozzle line C, and a black ink nozzle line K are formed. Each of these nozzle lines has one hundred and eighty nozzles 32. Among these one hundred and eighty nozzles 32, a nozzle that is relatively closer to the leftmost one is assigned a relatively smaller ordinal number (#i=#1-#180) with the leftmost one being the first. The nozzles 32 in each nozzle line are aligned in the direction of the width of the paper with certain intervals D (nozzle pitch D) allocated therebetween. In addition, each of the heads 31 is arranged in such a manner that the interval between the nozzle #180 of the left one of any two adjacent heads 31 arranged in the direction of the width of the paper and the nozzle #1 of the right one thereof equals D. In other words, in the printer 1, the length of the nozzle line for each color aligned in the direction of the width of the paper defines the maximum width of a printable paper. In addition, the interval D (nozzle pitch D) defines the minimum dot pitch viewed in the direction of the width of the paper.

Printing Operation

Figure 5:
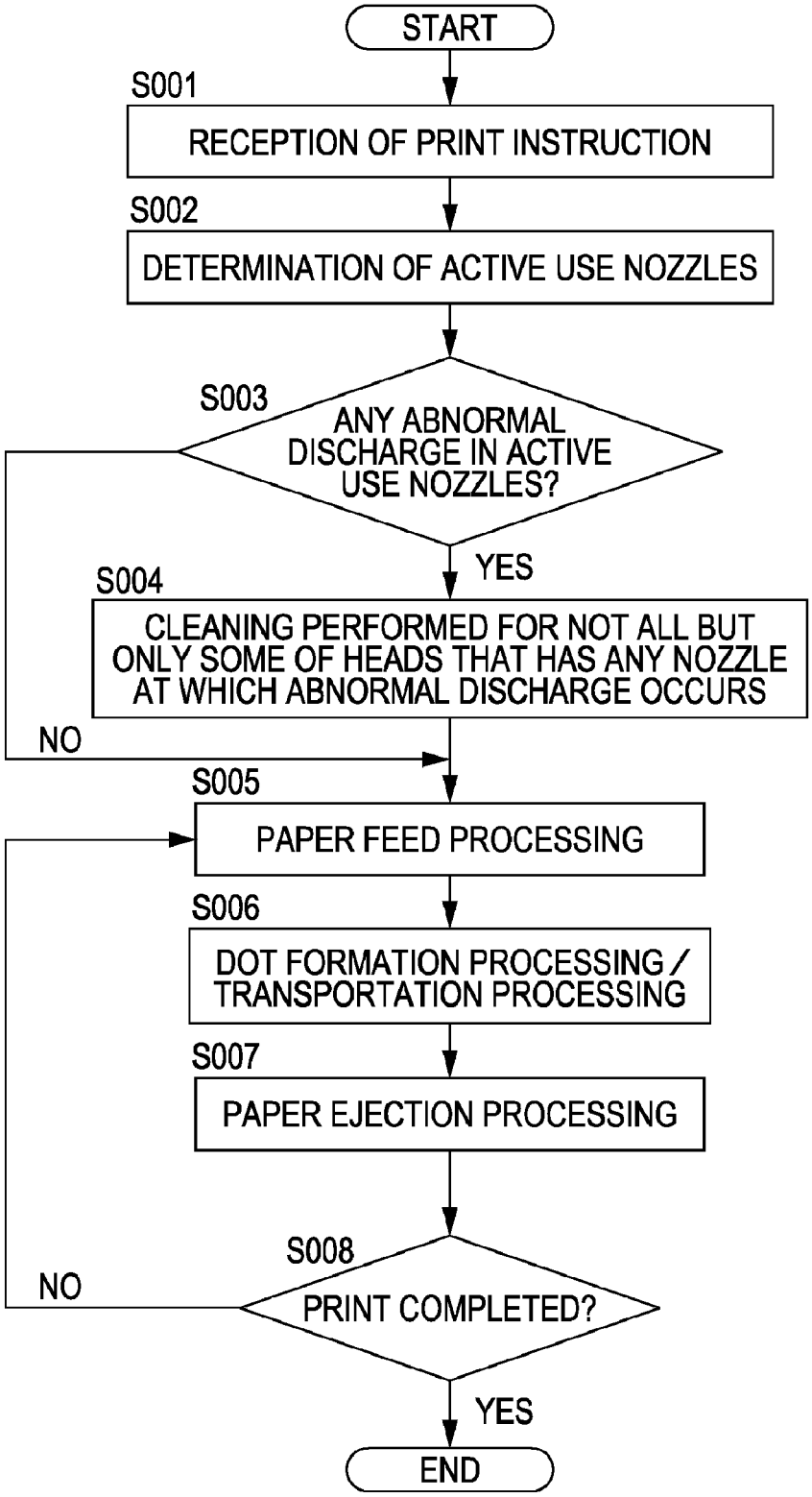
FIG. 5 is a flowchart that shows the flow of print processing.

FIG. 5 is a flowchart that shows the flow of print processing. Each of processing steps described below is executed through the functioning of the controller 10, which controls each unit in accordance with a program stored in the memory 13. The program contains codes for execution of respective processing steps.

Print Command Reception (S001): Firstly, the controller 10 receives a printing instruction from the computer 50 via the interface section 11. This printing instruction is contained in the header portion of print data that is sent from the computer 50. Then, the controller 10 analyzes the contents of various commands contained in the received print data so as to perform paper-feed processing, transport processing, dot formation processing, and so on, each of which is described below, by means of each functional unit.

Determination of Active Use Nozzle(s) (S002): On the basis of the print data, the controller 10 makes a determination, for each of the nozzles, as to whether ink is to be discharged or not from the nozzle of the head unit 31. That is, through this determination step, "active-use nozzles (active nozzles)", which are required to be activated for the formation of a print image, are selected.

Abnormal Discharge Test (S003): The controller 10 carries out an abnormal discharge inspection on "active use nozzles" only, which are selectively determined in the processing step 5002. In the test, the controller 10 makes a judgment, for each of the "active use nozzles", as to whether or not it is a malfunctioning one at which abnormal discharge occurs. Cleaning is performed if there are any malfunctioning nozzles among the active use nozzles. Cleaning is skipped if there are not any malfunctioning nozzles among the active use nozzles. The details of the abnormal discharge test will be described later.

Cleaning (S004): The controller 10 carries out cleaning on not all, but only some (or one) of heads that have any malfunctioning nozzle(s) among the "active use nozzles". The controller 10 performs cleaning on any malfunctioning nozzles that have caused abnormal discharge so that the cleaned nozzles discharge ink properly. The details of the cleaning will be described later.

Paper-feed Processing (S005): The paper-feed processing is a processing step in which the print target paper is supplied to the inside of the printer 1 so as to determine the position of the paper at the print start location (also referred to as the cue position). The controller 10 rotates the paper feed roller 23 to feed the print target paper onto the belt 22. Then, the controller 10 rotates the transporting rollers 21A and 21B to determine the position of the paper, which has been transferred from the paper feed roller 23, at the print start location. When the position of the paper is determined at the print start location, at least some of the nozzles of the head 31 are opposed to the paper.

Dot Formation Processing/Transportation Processing (S006): In a line head printer (the printer 1), dot formation processing and paper transportation processing are conducted concurrently. That is, ink is discharged intermittently from nozzles during a period in which a paper is being transported at a certain speed by a belt conveyor system. As a result thereof, a dot column (raster line), which consists of a plurality of dots, is formed on the paper along the direction of transportation.

Paper-ejection Processing (S007): Upon completion of print image formation on the paper that is currently being subjected to print processing, the controller 10 performs paper ejection.

Continuous Printing Judgment (S008): The controller 10 judges whether printing is to be continued or not. If the same image is to be continuously printed onto the next sheet of paper, the paper-feed processing of the next sheet of paper is initiated. If printing is not to be continued onto the next sheet of paper, the printing operations are ended.

Determination of Active Use Nozzles (S002)

Figure 6:
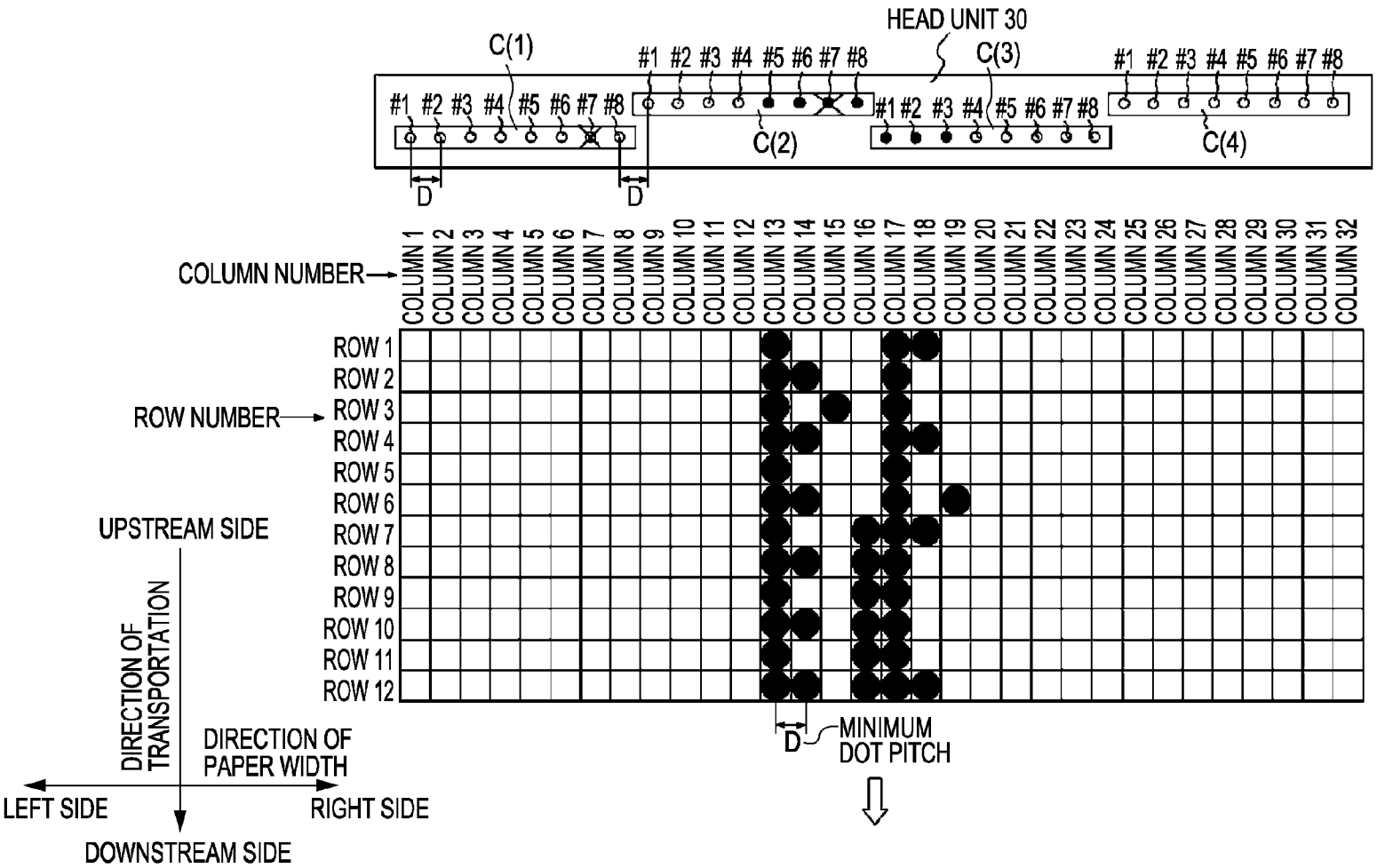
FIG. 6 illustrates a relationship between a paper on which the formation of a print image is completed and the head unit.

FIG. 6 illustrates a relationship between a paper on which the formation of a print image is completed and the head unit 30. To simplify explanation, however, FIG. 6 does not show all four nozzle lines in the head 31 but shows the cyan ink nozzle line C only. In addition, the number of nozzles in the nozzle line is reduced to eight for further simplicity. In FIG. 6, a virtual quadrille pattern is formed on the paper (target object S). Each of squares in the quadrille pattern is called a "pixel", which is provided herein to specify the position where a dot is recorded. In order to make it possible to identify any specific pixel for explanation, a group of pixels that are aligned in the direction of the width of the paper is denoted as a "row", whereas a group of pixels that are aligned in the direction of transportation is denoted as a "column". Among these columns, a column that is relatively closer to the leftmost one when viewed along the direction of the width of the paper is assigned a relatively smaller ordinal number with the leftmost one being the first. Among these lines, a line that is relatively closer to the most upstream one when viewed along the direction of transportation is assigned a relatively smaller ordinal number with the most upstream one being the first.

Printing operation starts when the controller 10 receives a printing instruction (S001). Then, the controller 10 makes determination, for each of nozzles, as to whether it is an "active nozzle", which is used for and contributes to the formation of a print image, or an "inactive nozzle".

Firstly, on the basis of a positional relationship between the paper and the head unit 30, the controller 10 assigns "responsible pixels" to the nozzle #i. Herein, the term "responsible pixels" means a group of pixels that are assigned to the nozzle #i so that the nozzle #i is in charge of forming dots therefor. That is, if it is necessary to form dots at the responsible pixels of the nozzle #i, the nozzle #i discharges ink onto the pixel(s). The nozzle #i is determined as an "active nozzle" if it is necessary to form dots in at least one of the responsible pixels of the nozzle #i in order to form the print image. On the other hand, the nozzle #i is determined as an "inactive nozzle" if it is not necessary to form dots in any one of the responsible pixels of the nozzle #i in order to form the print image.

It is assumed here that print processing is performed to complete a print image illustrated in FIG. 6. Each of the filled circles (●) illustrated in the pixels shown in FIG. 6 denotes a dot of cyan ink. The controller 10 receives a printing instruction "Form a print image illustrated in FIG. 6" from the computer 50, and also receives image data. On the basis of the received image data, the controller 10 checks whether dots should be formed in the responsible pixels of each nozzle or not. The image data means an aggregate of pixel data that contains information on whether dots should be formed in the corresponding pixels or not. Then, the controller 10 makes determination, for each of nozzles, as to whether it is an "active nozzle" or an "inactive nozzle".

The nozzle #1 of the cyan ink nozzle line C(1) of the head (1) [hereafter simply referred to as the nozzle #1 of C(1)] is taken as an example. The responsible pixels of the nozzle #1 of C(1) are pixels aligned in the first column. On the basis of the pixel data, the controller 10 judges that it is not necessary to form cyan ink dots at the responsible pixels of the nozzle #1 of C(1). Consequently, the controller 10 determines that the nozzle #1 of C(1) is an "inactive nozzle". On the other hand, on the basis of the pixel data, the controller 10 judges that it is necessary to form cyan ink dots at all of the responsible pixels of the nozzle #5 of the cyan ink nozzle line C(2) of the head (2) [hereafter simply referred to as the nozzle #5 of C(2)] aligned in the thirteenth column, which are arranged in a line extending across the first row through the twelfth row. Consequently, the controller 10 determines that the nozzle #5 of C(2) is an "active nozzle". As an additional example, on the basis of the pixel data, the controller 10 judges that it is necessary to form cyan ink dots at the pixel of the third row of the responsible pixels of the nozzle #7 of the cyan ink nozzle line C(2) of the head (2) [hereafter simply referred to as the nozzle #7 of C(2)], where the responsible pixels of the nozzle #7 of C(2) are the pixels aligned in the fifteenth column. Accordingly, the controller 10 determines that the nozzle #7 of C(2) is an "active nozzle". That is, regardless of whether dots should be formed in all of the responsible pixels of a nozzle as exemplified in the nozzle #5 of C(2), or they should be formed in only one of the responsible pixels of a nozzle as exemplified in the nozzle #7 of C(2), the nozzle in question is judged to be an "active nozzle" as long as it is necessary to form dots in any of its responsible pixels.

In this way, the controller 10 determines the nozzles #5-#8 of the cyan ink nozzle line C(2) of the head 31(2) and the nozzles #1-#3 of the cyan ink nozzle line C(3) of the head 31(3) illustrated in FIG. 6 to be "active nozzles". On the other hand, the controller 10 determines all nozzles of the cyan ink nozzle line C of the heads 31(1) and 31(4), the nozzles #1-#4 of the cyan ink nozzle line C(2) of the head 31(2), and the nozzles #4-#8 of the cyan ink nozzle line C(3) of the head 31(3) illustrated therein to be "inactive nozzles". It should be noted that, in FIG. 6, an "active nozzle" is denoted as a filled circle "●", whereas an "inactive nozzle" is denoted as an open circle "○".

Abnormal Discharge Test (S003)

Before entering into a printing process, the controller 10 performs an abnormal discharge test on the "active nozzles". The term "abnormal discharge" means a phenomenon of non-discharge of ink from a nozzle when it is supposed to be discharged therefrom. In addition, the term "abnormal discharge" applies also to a case where ink is not discharged from a nozzle in a direction perpendicular to the target paper. That is, this term also applies when it is discharged at an oblique angle with respect thereto. Abnormal discharge as described above could occur when a nozzle is clogged due to the thickening of ink, the adhesion of any foreign particle such as paper dust onto a nozzle, etc., or when air bubbles enter into the pressure chamber (cavity) of a head, among other reasons.

If abnormal discharge occurs during a printing process, some dots will be missing in a printed image, which could degrade the quality of the final image. In order to address such a problem, the controller 10 detects a malfunctioning nozzle (s) at which abnormal discharge occurs before the start of printing. Then, if there are any malfunctioning nozzles, cleaning (which will be described later) is performed so as to ensure that ink is discharged properly.

Abnormal Discharge Test By Laser

Figure 7:
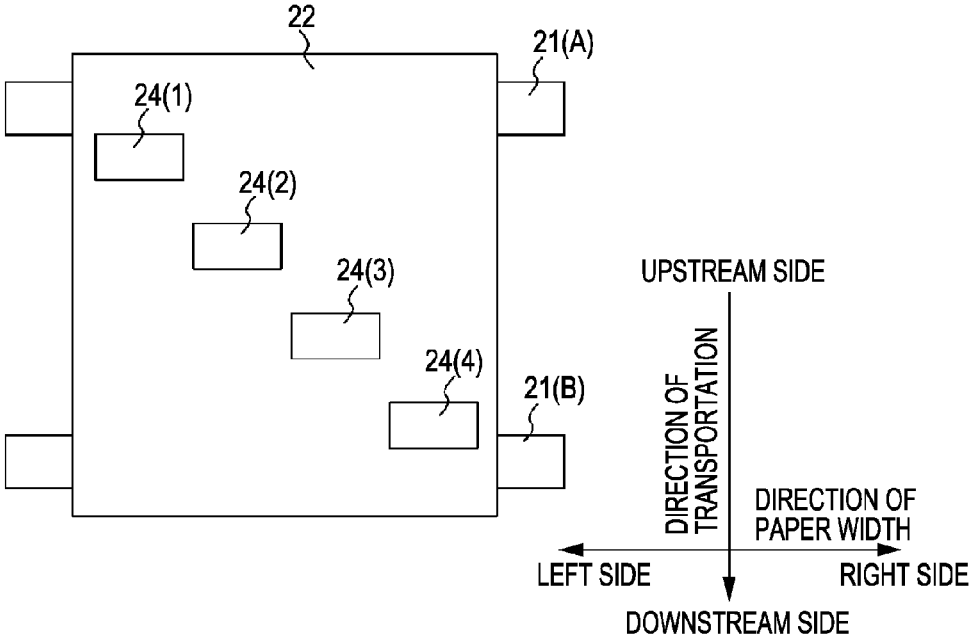
FIG. 7 illustrates the transporting rollers and the belt viewed from the top.
Figure 8:
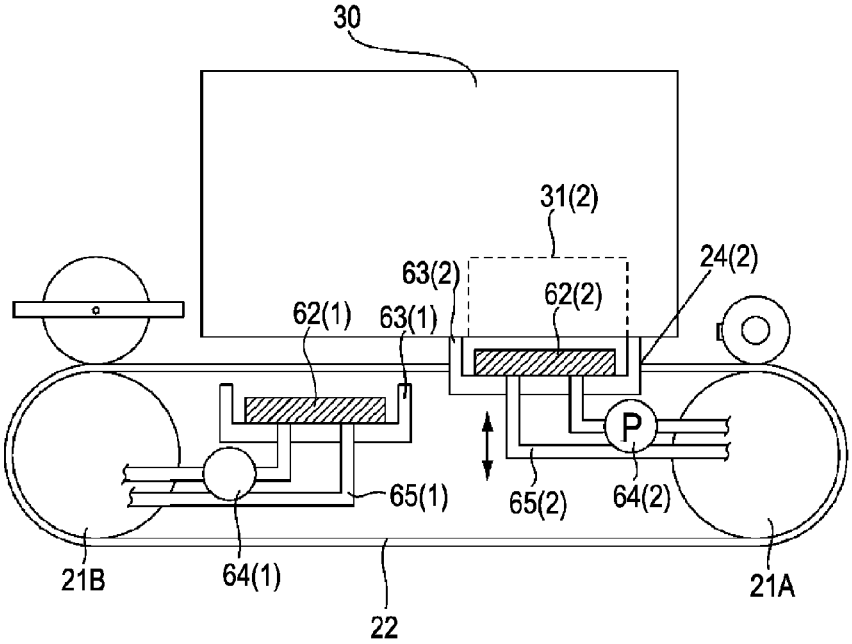
FIG. 8 illustrates the positional relationship between a pump suction apparatus and the head unit.

Because ink is discharged from a nozzle during the abnormal discharge test, it is necessary to have the configuration described below. FIG. 7 schematically illustrates the transporting rollers 21A and 21B and the belt 22 viewed from the top. The belt 22 has openings 24 each of which is as large as the head 31. One opening 24 is provided for each head. That is, the belt 22 is provided with four openings. The positions of these four openings 24 (refer to FIG. 7) are different from those of four heads 31 in the head unit (refer to FIG. 4). Each of the openings 24 is provided at a position that is the same as that of a corresponding head 31 when viewed in the direction of the width of the paper; however, none of these openings 24 overlaps one another when viewed in the direction of transportation. As the belt 22 has the openings 24 in such an arrangement pattern, the strength of the belt 22 is maintained. Among these openings 24, an opening that is relatively closer to the leftmost one when viewed along the direction of the width of the paper is assigned a relatively smaller ordinal number in parenthesis with the leftmost one being the first. FIG. 8 illustrates the positional relationship between a pump suction apparatus and the head unit 30. The pump suction apparatus includes an ink absorber 62, a cap 63, a pump 64, a tube 65, and a mechanism that moves the pump suction apparatus in a vertical direction (the last one is not shown in the drawing). Each head is provided with one pump suction apparatus.

As a preparatory operation conducted before an abnormal discharge test, it is necessary to oppose the lower surface of the test target head to the pump suction apparatus. For example, it is assumed here that the abnormal discharge test of the head 31(2) is conducted. Firstly, the position of the lower surface of the head 31(2) is aligned with the position of the opening 24(2) of the belt 22, which lies at the same position as the head 31(2) when viewed along the direction of the width of the paper. The belt 22 is rotated by means of the transporting rollers 21A and 21B for alignment thereof. Thereafter, the pump suction apparatus is lifted so that the lower surface of the head 31(2) contacts the cap 63(2). The abnormal discharge test of the head (2) is conducted in such a contact state. By this means, even when ink is discharged from a nozzle during a test, it is discharged inside the cap 63. Therefore, the belt 22, among other components, is prevented from being stained by ink.

Figure 9:
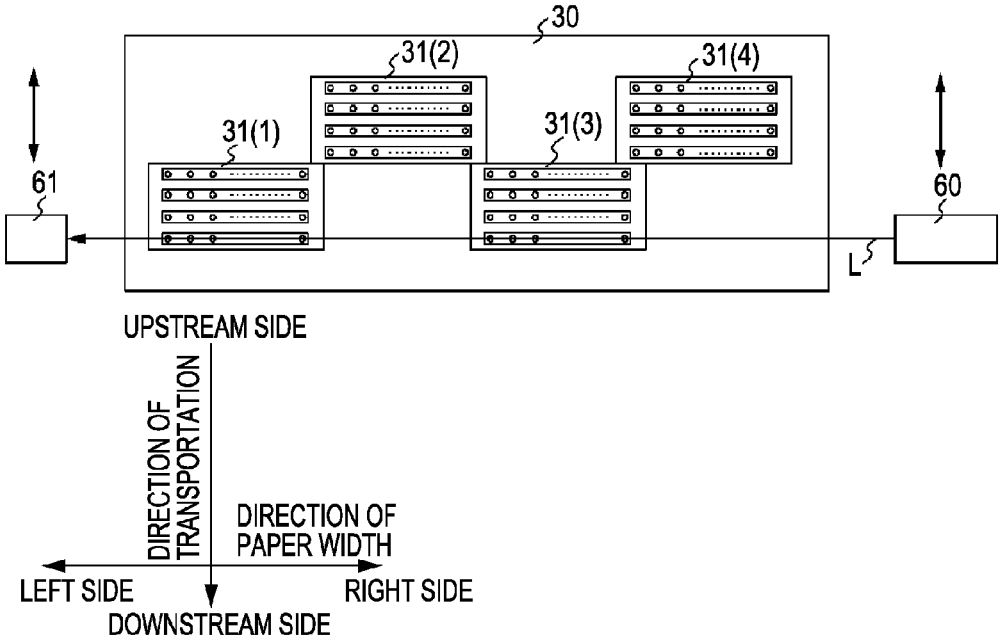
FIG. 9 illustrates the head unit and an abnormal discharge test section viewed from the bottom.

FIG. 9 schematically illustrates the head unit 30 and an abnormal discharge test section viewed from the bottom. The abnormal discharge test section is provided with a laser light source 60, a laser light reception device 61, and a mechanism that moves the laser light source 60 and the laser light reception device 61 in the direction of transportation (not shown in the drawing). The laser light source 60 emits a laser light beam L. As illustrated in FIG. 9, the laser light beam L is emitted in parallel with the nozzle line.

The laser light source 60 and the laser light reception device 61 are arranged in such a manner that the trajectory of ink discharged properly from each nozzle intersect the laser light beam L. When a predetermined amount of ink is discharged properly from a nozzle, the laser light beam L is shut off by the ink. Therefore, the abnormal discharge test section is able to detect an abnormal discharge state, including a state where no ink is discharged from a nozzle at all or a predetermined amount of ink is not discharged at a proper position.

Figure 10A:
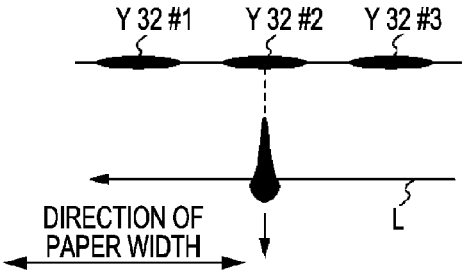
FIG. 10*a* illustrates a proper discharge state in which ink is discharged from a nozzle as it is supposed to be.

FIG. 10*a* illustrates a proper discharge state in which ink is discharged from a nozzle as it is supposed to be. As shown in FIG. 10*a*, a predetermined amount of ink is discharged in a direction perpendicular to the target paper from #2 nozzle of the nozzles 32 in the yellow ink nozzle line Y (hereafter referred to as the nozzle Y32#2). The discharged ink goes across the laser light beam L on the way to the target paper. Consequently, the laser light reception device 61 receives light, the amount of which is not more than a threshold value (or the reception of light is interrupted temporarily). In this case, the nozzle Y32#2 is judged to be a properly-functioning nozzle. Note that the threshold is a value that is predetermined based on the amount of light by which a predetermined amount of ink shuts off the laser light beam L.

Figure 10B:
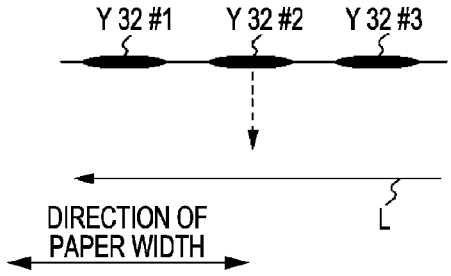
FIG. 10*b* illustrates a state in which no ink is discharged from the nozzle at all.
Figure 10C:
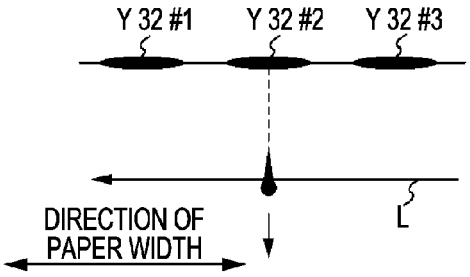
FIG. 10*c* illustrates a state in which some ink is discharged from the nozzle, where the amount thereof is not more than a predetermined ink amount.
Figure 10D:
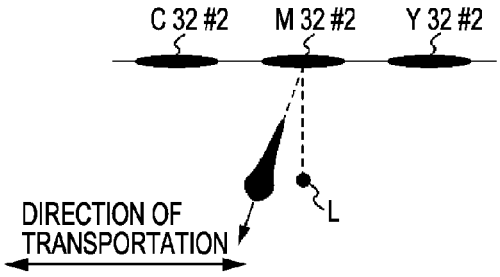
FIG. 10*d* illustrates a state in which, although ink is discharged from the nozzle, it is discharged not in the direction perpendicular to the paper but at an oblique angle thereto.

On the other hand, FIGS. 10*b*-10*d* illustrate malfunctioning discharge states in which ink is not discharged from a nozzle properly. FIG. 10*b* illustrates a state in which no ink is discharged from the nozzle Y32#2 at all. In this state, the laser light beam L is not shut off by any ink, resulting in that the laser light reception device 61 constantly receives the laser light beam L not blocked thereby. Consequently, it is judged that the nozzle Y32#2 is a malfunctioning nozzle at which abnormal discharge occurs. FIG. 10*c* illustrates a state in which some ink is discharged from the nozzle Y32#2, where the amount thereof is not more than a predetermined ink amount. In this state, although some part of the laser light beam L is shut off by ink, the laser light reception device 61 receives the laser light beam L whose amount of light is not less than the threshold value. Consequently, the nozzle Y32#2 is judged to be a malfunctioning nozzle. Unlike FIGS. 10*a*-10*c*, it is illustrated in FIG. 10*d* that the laser light beam L is emitted in a direction perpendicular to the plane of the drawing. According to FIG. 10*d*, although ink is discharged from the magenta ink nozzle M32#2, it is discharged not in the direction perpendicular to the paper but at an oblique angle with respect thereto. In this state, the laser light beam L is not shut off by any ink, resulting in that the laser light reception device 61 constantly receives the laser light beam L not blocked thereby. Consequently, the nozzle Y32#2 is judged to be a malfunctioning nozzle.

The abnormal discharge test is conducted as described above. Upon completion of the abnormal discharge test on one nozzle, the abnormal discharge test is continued to be conducted on the next nozzle. For example, FIG. 6 shows that the nozzles #1-#3 of the cyan ink nozzle line C(3) of the head (3) and the nozzles #5-#8 of the cyan ink nozzle line C(2) of the head (2) are "active nozzles". Firstly, the abnormal discharge test is conducted on the nozzle #3 of the cyan ink nozzle line C(3) of the head (3). Then, the test is conducted on the nozzle C(3)#2, which is followed by the test conducted on the nozzle C(3)#1. Upon completion of the above, the laser light source 60 and the laser light reception device 61 move to a position where the laser light beam L intersects ink discharged from each of the nozzles of the cyan ink nozzle line C(2) of the head (2). Thereafter, the abnormal discharge test is conducted on the nozzles #8, #7, #6, and #5 of the cyan ink nozzle line C(2) of the head (2) in the order of appearance herein. That is, the test is conducted for each nozzle.

By the way, for the purpose of hypothetical discussion, it is assumed here that the abnormal discharge test is conducted on "all of nozzles" regardless of whether they are "active nozzles" or "inactive nozzles". On the basis of such an assumption, according to FIG. 6, it follows that the abnormal discharge test would be conducted on all nozzles in each of these four cyan ink nozzle lines. In other words, this means that the abnormal discharge test would be conducted on thirty-two nozzles. However, it would take a longer time than desired to perform the abnormal discharge test. What is worse, it would involve increased amount of ink being used for the abnormal discharge test.

In order to avoid such disadvantages, according to the present embodiment of the invention, the abnormal discharge test is conducted on the "active nozzles" only so as to reduce the number of nozzles that is subjected to the abnormal discharge test. According to a specific example illustrated in FIG. 6, it means that it is sufficient if the abnormal discharge test is conducted only on seven "active nozzles" that are denoted by filled circles (●). Consequently, because the test is conducted on a nozzle-by-nozzle basis, it is possible to save time which would be otherwise required for moving the laser light source 60 and the laser light reception device 61 for inspection of the "inactive nozzles" and time for inspecting whether any ink is discharged from the "inactive nozzles" or not, or whether the discharged ink shuts off the laser light beam or not. Thus, test time is shortened, which further shortens printing time. What is more, it is further possible to reduce the amount of ink that is used for the abnormal discharge test.

According to the present embodiment of the invention, the abnormal discharge test is not carried out on the "inactive nozzles". However, because the quality of a printed image is not affected at all even if some "inactive nozzles" are in a state that causes abnormal discharge, it does not pose any problem even if the abnormal discharge test is not conducted for the "inactive nozzle(s)".

Cleaning (S004)

Cleaning is performed if any malfunctioning nozzle at which abnormal discharge occurs is detected among the "active nozzles" in the abnormal discharge test described above. Cleaning is conducted so that all of the "active nozzles" discharge ink properly. Flushing and pump suction are conducted as examples of the cleaning. Cleaning is conducted only on heads that have any malfunctioning nozzles.

For example, it is assumed here that the nozzle #7 of the cyan ink nozzle line C(2) of the head 31(2), which is denoted by a cross mark in FIG. 6, is detected as a malfunctioning nozzle. Under such an assumption, cleaning is performed for the head 31(2) only. As a preparatory operation conducted before cleaning, it is necessary to oppose the lower surface of the cleaning target head to the pump suction apparatus. This is the same as the preparatory operation conducted for the abnormal discharge test. That is, the position of the lower surface of the head 31(2) is aligned with the position of the opening 24(2) of the belt 22. It is sufficient as long as the lower surface of the head 31(2) contacts the cap 63(2).

Flushing, which is one method of cleaning, is a cleaning operation for attempting to forcibly discharge ink drops from a nozzle. Even when a nozzle is unable to discharge any ink drops due to the clogging thereof, the meniscus of the nozzle (the free surface of ink exposed by the nozzle) vibrates when the pressure chamber expands and contracts. As a result thereof, the nozzle becomes unclogged so as to discharge ink drops properly if the ink contained in the pressure chamber has not thickened so much. Pump suction is a cleaning operation for forcibly vacuuming up ink contained in a pressure chamber by driving a pump. One end of the tube 65, which is the drain path of ink, is connected to the bottom surface inside the cap 63, whereas the other end thereof is connected to a drain ink cartridge (not shown in the drawing) through a tube pump. The ink absorber 62 is provided on the bottom surface inside the cap 63. The ink absorber 62 absorbs not only drain ink that is vacuumed up by the pump but also drain ink due to abnormal discharge test and flushing. The drain ink is drained to the drain ink cartridge via the tube 65.

Through these cleaning operations, it is possible to discharge any foreign objects that adhere to the surface of a nozzle together with ink drops, return the meniscus of a nozzle that is in a dry state due to thickening to its normal state, and to remove any air bubbles in the pressure chamber (cavity) of the head. By this means, all of the "active nozzles" are made to discharge ink properly.

By the way, for the purpose of hypothetical discussion, it is assumed here that the abnormal discharge test is conducted on "all of the nozzles". Under such an assumption, there may be a case where some of the "inactive nozzles" are detected as malfunctioning nozzle(s). For example, it is assumed here that the nozzle #7 of the cyan ink nozzle line C(2) of the head (2) and the nozzle #7 of the cyan ink nozzle line C(1) of the head (1), each of which is denoted by a cross mark in FIG. 6, are detected as malfunctioning nozzles. Consequently, it follows that the "inactive nozzles" would also be cleaned. For example, it follows that not only the nozzle C(2)#7, which is an "active nozzle", but also the nozzle C(1)#7, which is an "inactive nozzle", would also be subjected to cleaning. In other words, cleaning operations would be conducted on two heads, that is, the heads (1) and (2). However, it will take a longer time than desired to perform the cleaning. What is worse, it involves an increase in the amount of ink used for the cleaning.

In order to avoid such disadvantages, according to the present embodiment of the invention, the abnormal discharge test is conducted on the "active nozzles" only. Cleaning is conducted only when any malfunctioning nozzles are detected among the "active nozzles". Accordingly, it is possible to reduce the number of heads that are cleaned. In addition, it is also possible to shorten time that is required for aligning the lower surface of the head with the opening of the belt, and time that is required for performing flushing and pump suction. Thus, it is further possible to shorten cleaning time. For example, in FIG. 6, it is sufficient if the head (2) only is cleaned. In addition, it is also possible to reduce the amount of drain ink due to cleaning.

According to the present embodiment of the invention, cleaning is not performed even if there are some malfunctioning nozzles in the "inactive nozzles". However, because the quality of a printed image is not affected at all even if some "inactive nozzles" is in a state that causes abnormal discharge, it does not pose any problems even if the cleaning is not conducted for the malfunctioning nozzles in the "inactive nozzles". In a practical sense, however, whether there are any malfunctioning nozzles or not is not recognized because the abnormal discharge test is not conducted for the "inactive nozzles".

Other Embodiment 1

In the foregoing description, an embodiment of a line head printer is explained. Other than the line head printer, ink-jet type printers include a carriage-type printer, which performs printing while moving its head. In the following description, an embodiment of the carriage-type printer (printer 2) is explained.

Printer 2

Figure 11:
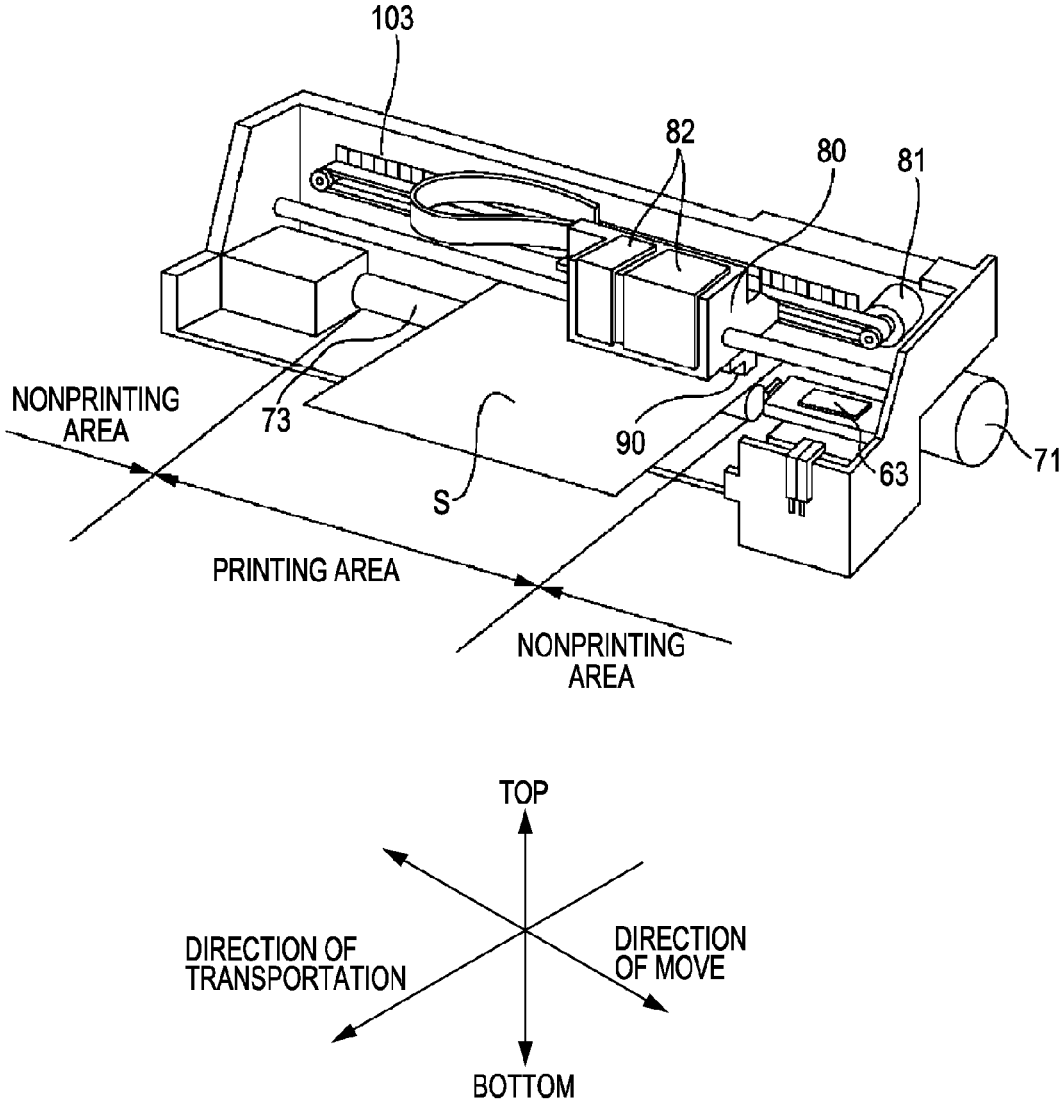
FIG. 11 is a schematic diagram that illustrates the overall configuration of the printer.
Figure 12:
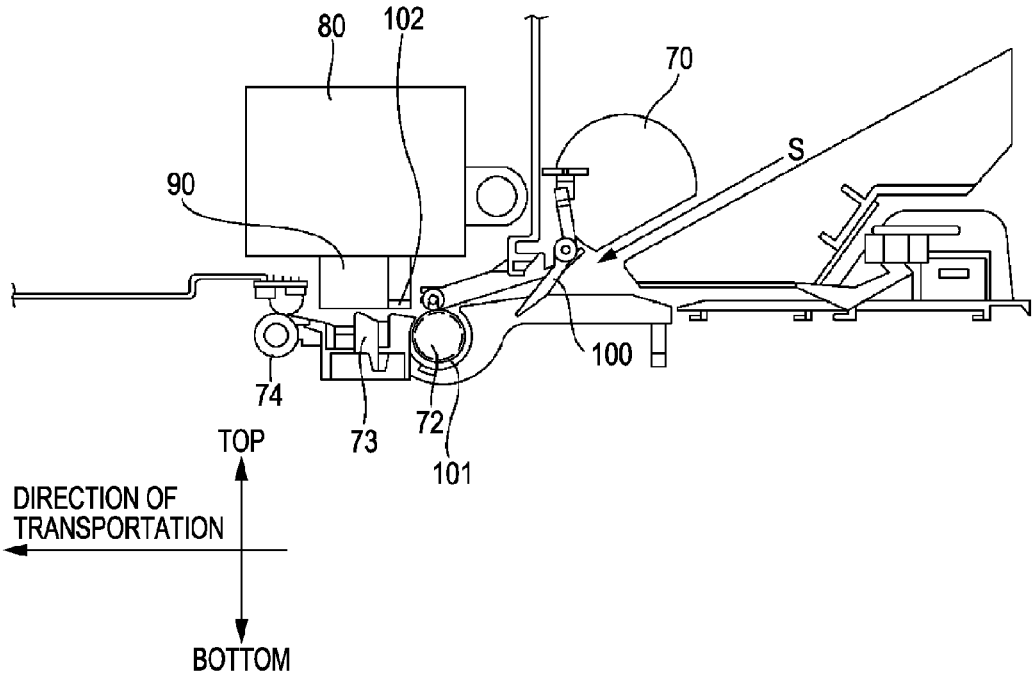
FIG. 12 is a sectional view that illustrates the overall configuration of the printer.

FIG. 11 is a schematic diagram that illustrates the overall configuration of the printer 2. FIG. 12 is a sectional view that illustrates the overall configuration of the printer 2. The greatest difference between the line head printer (printer 1) described above and the carriage-type printer (printer 2) lies in that, according to the latter, the head 90 moves in a moving direction illustrated in FIG. 11, and ink is discharged intermittently from nozzles during the move to form a dot line (a raster line) in the direction of move. Then, as the head 90 travels in the moving direction once, the transporting unit transports the paper in the direction of transportation. The carriage-type printer repeats the dot formation operation by means of the moving head and the paper transportation operation in an alternating manner so as to complete a printed image. In order to perform such a printing, the printer 2 is further provided with a carriage unit in addition to a transporting unit, a head unit, a group of detectors, and a controller.

Figure 13:
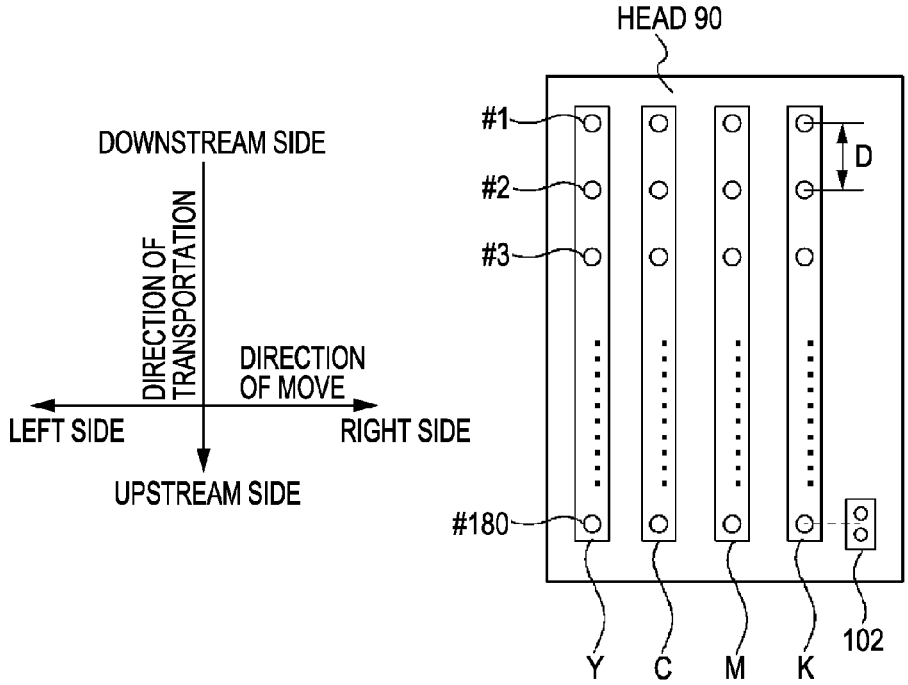
FIG. 13 is an explanatory diagram that illustrates a nozzle alignment pattern at the lower surface of the head.

The carriage unit has a carriage 80 and a carriage motor 81. Driven by the carriage motor 81, the carriage 80 is capable of reciprocating in the direction of move. As the head 90 is provided on the carriage 80, it can move in the direction of move. FIG. 13 is an explanatory diagram that illustrates a nozzle alignment pattern at the lower surface of the head 90. At the lower surface of the head 90, a yellow ink nozzle line Y, a cyan ink nozzle line C, a magenta ink nozzle line M, and a black ink nozzle line K are formed. Each nozzle line is provided with one hundred and eighty nozzles. Among these one hundred and eighty nozzles, a nozzle that is relatively closer to the most downstream one is assigned a relatively smaller ordinal number (#i=#1-#180) with the most downstream one being the first. The nozzles in each nozzle line are aligned in the direction of transportation with certain intervals (nozzle pitch D) allocated therebetween.

The transporting unit is provided with a paper feed roller 70, a transporting motor 71, a transporting roller 72, a platen 73, and a paper ejection roller 74. The paper is automatically fed into the printer 2 through the rotation of the paper feed roller 70. The transporting roller 72, which is rotated by the transporting motor, transports the paper that is fed thereto to a printable area. The platen supports the paper under printing. The paper ejection roller 74 is a roller that ejects the printed-paper to the outside of the printer 2. The paper ejection roller 74 rotates in synchronization with the transporting roller 72.

Determination of Active Nozzles

Figure 14:
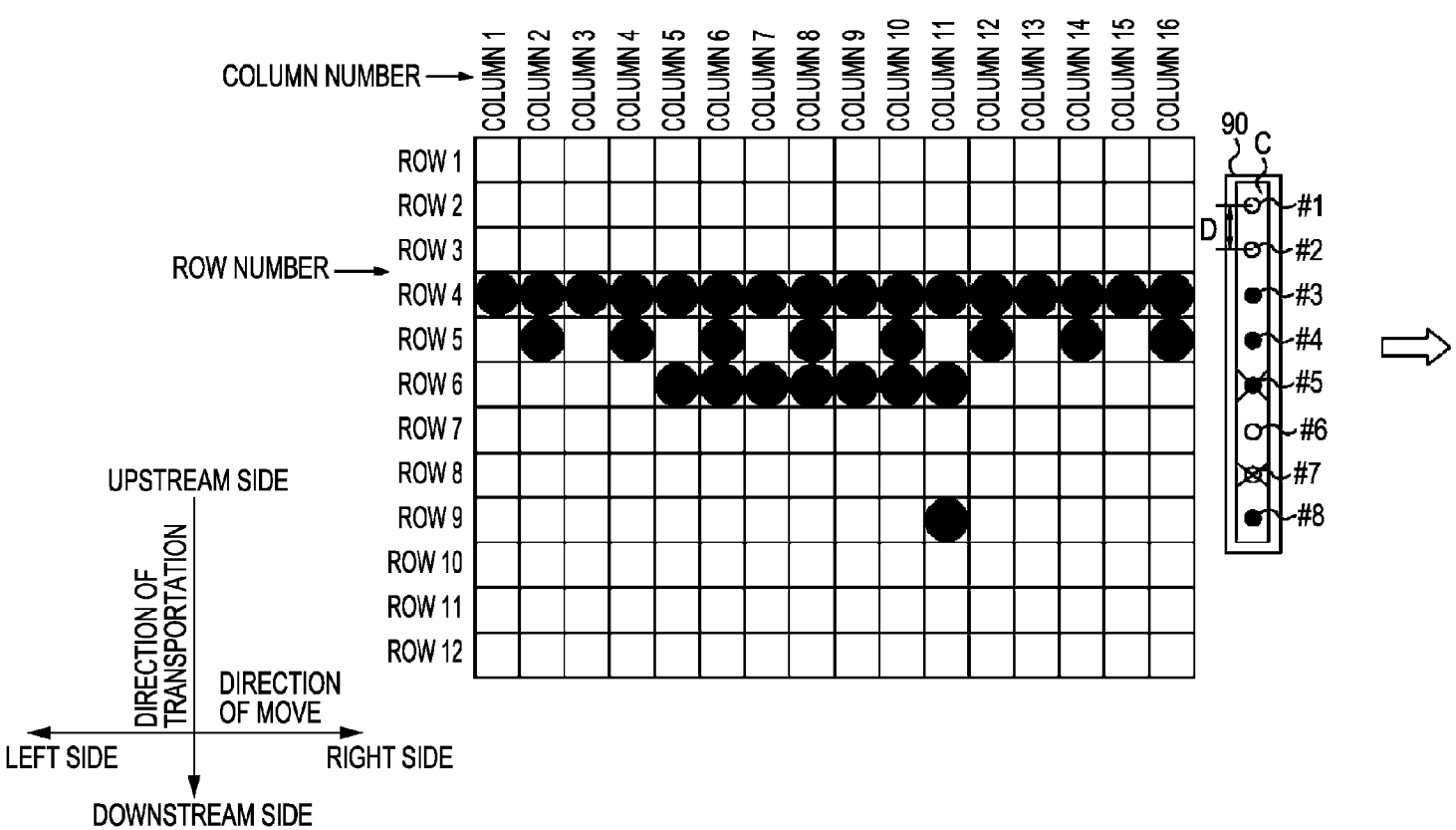
FIG. 14 illustrates a relationship between a paper on which the formation of a print image is completed and the head.

FIG. 14 illustrates a relationship between a paper on which the formation of a print image is completed and the head 90. To simplify explanation, however, FIG. 14 does not show all of four nozzle lines in the head 90 but shows the cyan ink nozzle line C only. In addition, the number of nozzles in the nozzle line is reduced to eight for further simplicity. In FIG. 14, in order to make it possible to identify any specific pixel for explanation, a group of pixels that are aligned in the direction of move is denoted as a "row", whereas a group of pixels that are aligned in the direction of transportation is denoted as a "column".

In the same manner as in the line head printer described above, the printing operation starts when the controller receives a printing instruction. Then, the controller makes determination, for each of nozzles of the head 90, as to whether it is an "active nozzle", which is used for and contributes to the formation of a print image, or an "inactive nozzle".

Firstly, on the basis of a positional relationship between the paper and the head 90, the controller assigns "responsible pixels" to the nozzle #i. Herein, the term "responsible pixels" means a group of pixels that are assigned to the nozzle #i so that the nozzle #i is in charge of forming dots therefor. That is, if it is necessary to form dots at the responsible pixels of the nozzle #i, the nozzle #i discharges ink onto the pixel(s). The nozzle #i is determined as an "active nozzle" if it is necessary to form dots in at least one of the responsible pixels of the nozzle #i in order to form a print image. On the other hand, the nozzle #i is determined as an "inactive nozzle" if it is not necessary to form dots in any one of the responsible pixels of the nozzle #i in order to form a print image.

It is assumed here that print processing is performed to complete a print image illustrated in FIG. 14. Each of the filled circles (●) illustrated in the pixels shown in FIG. 14 denotes a dot of cyan ink. On the basis of image data for completion of a print image illustrated in FIG. 14, the controller checks whether it is necessary to form dots in the responsible pixels of each nozzle or not. Then, the controller makes determination, for each of nozzles, as to whether it is an "active nozzle" or an "inactive nozzle".

For example, on the basis of the pixel data, the controller judges that it is not necessary to form cyan ink dots at the pixel in the second row of the responsible pixels of the nozzle #1 of the cyan ink nozzle line C (hereafter simply referred to as the nozzle #1). Consequently, the controller determines that the nozzle #1 is an "inactive nozzle". On the other hand, on the basis of the pixel data, the controller judges that it is necessary to form cyan ink dots at all of the responsible pixels of the nozzle #3 of the cyan ink nozzle line C (hereafter simply referred to as the nozzle #3) aligned in the fourth row, which are arranged in a line extending across the first column through the sixteenth column. Consequently, the controller determines that the nozzle #3 is an "active nozzle". As another example, on the basis of the pixel data, the controller judges that it is necessary to form cyan ink dots at the pixel of the eleventh column of the responsible pixels of the nozzle #8 of the cyan ink nozzle line C (hereafter simply referred to as the nozzle #8), where the responsible pixels of the nozzle #8 are the pixels aligned in the ninth row. Accordingly, the controller determines that the nozzle #8 is an "active nozzle". That is, regardless of whether dots should be formed in all of the responsible pixels of a nozzle as exemplified in the nozzle #3, or they should be formed in only one of the responsible pixels of a nozzle as exemplified in the nozzle #8, the nozzle in question is judged to be an "active nozzle" as long as it is necessary to form dots in any of its responsible pixels.

In this way, the controller determines the nozzles #3, #4, #5, and #8 of the cyan ink nozzle line C illustrated in FIG. 14 as "active nozzles". On the other hand, the controller determines the nozzles #1, #2, #6, and #7 of the cyan ink nozzle line C illustrated therein as "inactive nozzles". It should be noted that, in FIG. 14, an "active nozzle" is denoted as a filled circle "●", whereas an "inactive nozzle" is denoted as an open circle "○".

Abnormal Discharge Test

Before entering into a printing process, the controller performs an abnormal discharge test only on the "active nozzles", which are determined in the above processing step. According to an example illustrated in FIG. 14, the abnormal discharge test is conducted only on the nozzles #3, #4, #5, and #8 of the cyan ink nozzle line C. The laser abnormal discharge test explained in the aforementioned embodiment is adopted.

Figure 15:
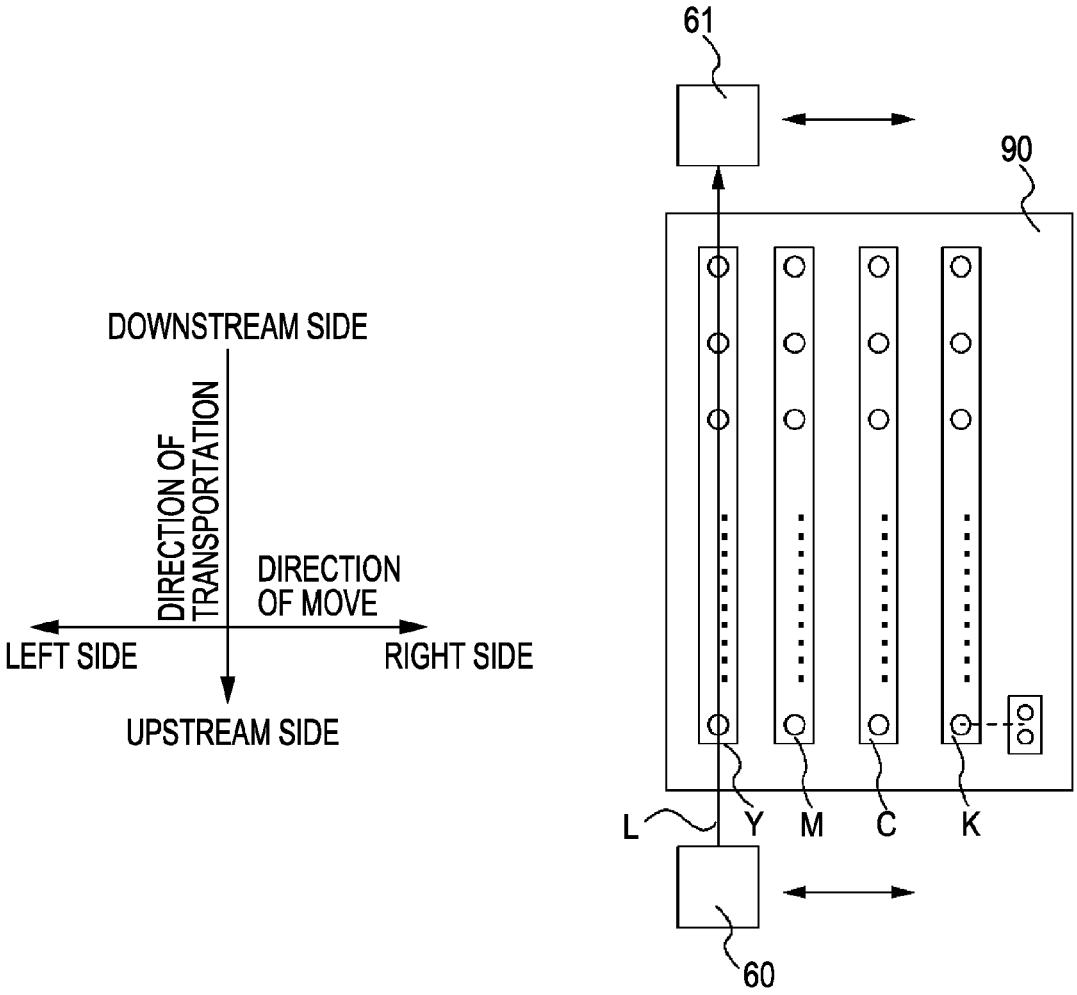
FIG. 15 illustrates the head and the abnormal discharge test section viewed from the bottom.

FIG. 15 schematically illustrates the head 90 and an abnormal discharge test section viewed from the bottom. The abnormal discharge test section is provided with a laser light source 60, a laser light reception device 61, and a mechanism that moves the laser light source 60 and the laser light reception device 61 in the direction of move (not shown in the drawing). The laser light source 60 emits the laser light beam L in parallel with the nozzle line. The method of detection is the same as that explained in the aforementioned embodiment. In addition, according to the printer 2, the laser light source 60 and the laser light reception device 61 travel in the direction of move. For example, upon completion of the test of the active nozzles in the yellow ink nozzle line Y, the laser light source 60 and the laser light reception device 61 travel in the direction of move for the purpose of conducting a test of the active nozzles in the magenta ink nozzle line M.

The abnormal discharge test is conducted at a nonprinting area. The nonprinting area is an area where, as illustrated in FIG. 11, no ink is discharged from nozzles for printing on a paper. That is, the paper is not transported to the nonprinting area. At the time when an abnormal discharge test is conducted, ink is discharged in the cap of a pump suction apparatus that is used for cleaning.

By the way, for the purpose of hypothetical discussion, it is assumed here that the abnormal discharge test is conducted on "all of the nozzles". On the basis of such an assumption, according to FIG. 14, it follows that the abnormal discharge test would be conducted on all nozzles in the cyan ink nozzle line. In other words, this means that the abnormal discharge test would be conducted on eight nozzles. However, it would take a longer time than desired to perform the abnormal discharge test. What is worse, it would involve increased amount of ink being used for the abnormal discharge test.

In order to avoid such disadvantages, according to Other Embodiment 1 of the invention, the abnormal discharge test is conducted on the "active nozzles" only so as to reduce the number of nozzles that is subjected to the abnormal discharge test. According to a specific example illustrated in FIG. 14, in Other Embodiment 1, it means that it is sufficient if the abnormal discharge test is conducted only on four "active nozzles" that are denoted by filled circles (●). Consequently, because the test is conducted on a nozzle-by-nozzle basis, it is possible to save time which would be otherwise required for moving the laser light source 60 and the laser light reception device 61 for inspection of the "inactive nozzles" and time for inspecting whether any ink is discharged from the "inactive nozzle" or not, or whether the discharged ink shuts off the laser light beam or not. Thus, test time is shortened, which further shortens printing time. What is more, it is further possible to reduce the amount of ink that is used for the abnormal discharge test.

According to Other Embodiment 1 of the invention, the abnormal discharge test is not carried out on the "inactive nozzles". However, because the quality of a printed image is not affected at all even if any "inactive nozzle(s)" is in a state that causes abnormal discharge, it does not pose any problem even if the abnormal discharge test is not conducted for the "inactive nozzle(s)".

Cleaning

Cleaning operations are conducted only when there is any malfunctioning nozzle at which abnormal discharge occurs, which is/are detected among the "active nozzles" in the abnormal discharge test described above. Flushing and pump suction are conducted as examples of the cleaning. Cleaning is conducted so that all of the "active nozzles" discharge ink properly. For example, it is assumed here that the nozzle #5 of the cyan ink nozzle line C of the head 90, which is denoted by a cross mark in FIG. 14, is detected as a malfunctioning nozzle. Under such an assumption, cleaning is conducted on the head 90.

Figure 16:
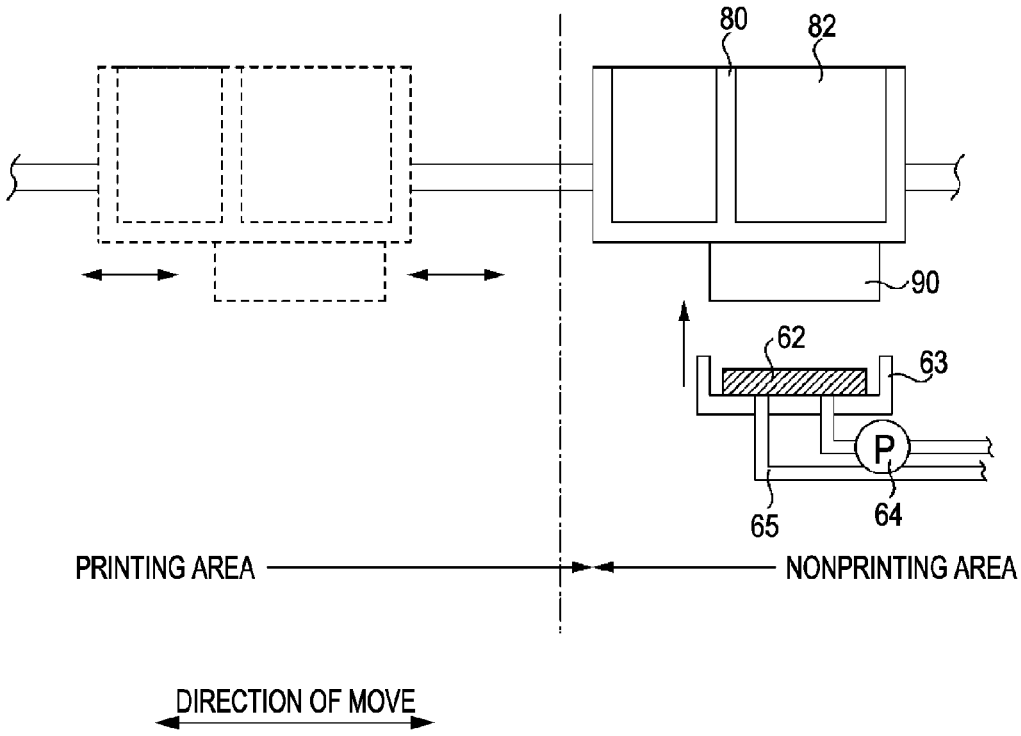
FIG. 16 illustrates the positional relationship between the pump suction apparatus and the head.

FIG. 16 illustrates the positional relationship between the pump suction apparatus and the head 90. The pump suction apparatus includes the ink absorber 62, the cap 63, the pump 64, the tube 65, and the mechanism that moves the pump suction apparatus in a vertical direction (the last one is not shown in the drawing). Likewise the abnormal discharge test, the cleaning of the head 90 is conducted at the nonprinting area. As the pump suction apparatus is provided in the nonprinting area, it can not travel in the direction of move. For this reason, the head 90 moves just above the pump suction apparatus that is provided in the nonprinting area at the time of cleaning. However, the move of a head does not occur because the head has already been positioned just above the pump suction apparatus in a cleaning conducted immediately after the abnormal discharge test. The methods of flushing and pump suction are the same as those explained in the aforementioned embodiment. All of the "active nozzles" discharge ink properly after these flushing and pump suction.

By the way, for the purpose of hypothetical discussion, it is assumed here that the abnormal discharge test is conducted on "all of the nozzles". On the basis of such an assumption, there may be a case where the nozzle #7 of the cyan ink nozzle line C, which is denoted by a cross mark in FIG. 14, is detected as a malfunctioning nozzle (it is assumed that the nozzle #5 is not a malfunctioning one herein). Consequently, it follows that the head 90 would be subjected to cleaning even though there is not any malfunctioning nozzle in the "active nozzles" because the nozzle #7, which is an "inactive nozzle", is a malfunctioning nozzle. However, this would disadvantageously increase the percentage that cleaning is conducted.

In order to avoid such disadvantages, according to Other Embodiment 1 of the invention, the abnormal discharge test is conducted on the "active nozzles" only. Cleaning is conducted only when any malfunctioning nozzle(s) is detected among the "active nozzles". As a result thereof, it is possible to decrease the percentage that cleaning is conducted, which results in the shortening of cleaning time and the reduction of the amount of ink that is used for cleaning.

According to Other Embodiment 1 of the invention, cleaning is not conducted even if there are some malfunctioning nozzles in the "inactive nozzles". According to a specific example illustrated in FIG. 14, cleaning is not conducted even if the nozzle #7, which is an "inactive nozzle", is a malfunctioning nozzle. However, because the quality of a printed image is not affected at all even if any "inactive nozzle(s)" is in a state that causes abnormal discharge, it does not pose any problem even if the cleaning is not conducted for the malfunctioning nozzle(s) in the "inactive nozzle(s)". In a practical sense, however, whether there are any malfunctioning nozzles or not is not recognized because the abnormal discharge test is not conducted for the "inactive nozzles".

Other Embodiment 2

According to the above embodiment of the invention, the abnormal discharge test is conducted on the "active nozzles" only. However, it may be configured that the abnormal discharge test is conducted on all nozzles, and that cleaning is conducted only if any malfunctioning nozzle is detected among the "active nozzles" as described below. It is possible to shorten cleaning time even with such a configuration. An explanation is given below based on the premise that the printer 1 has the same configuration as that of the aforementioned line head printer.

Figure 20:
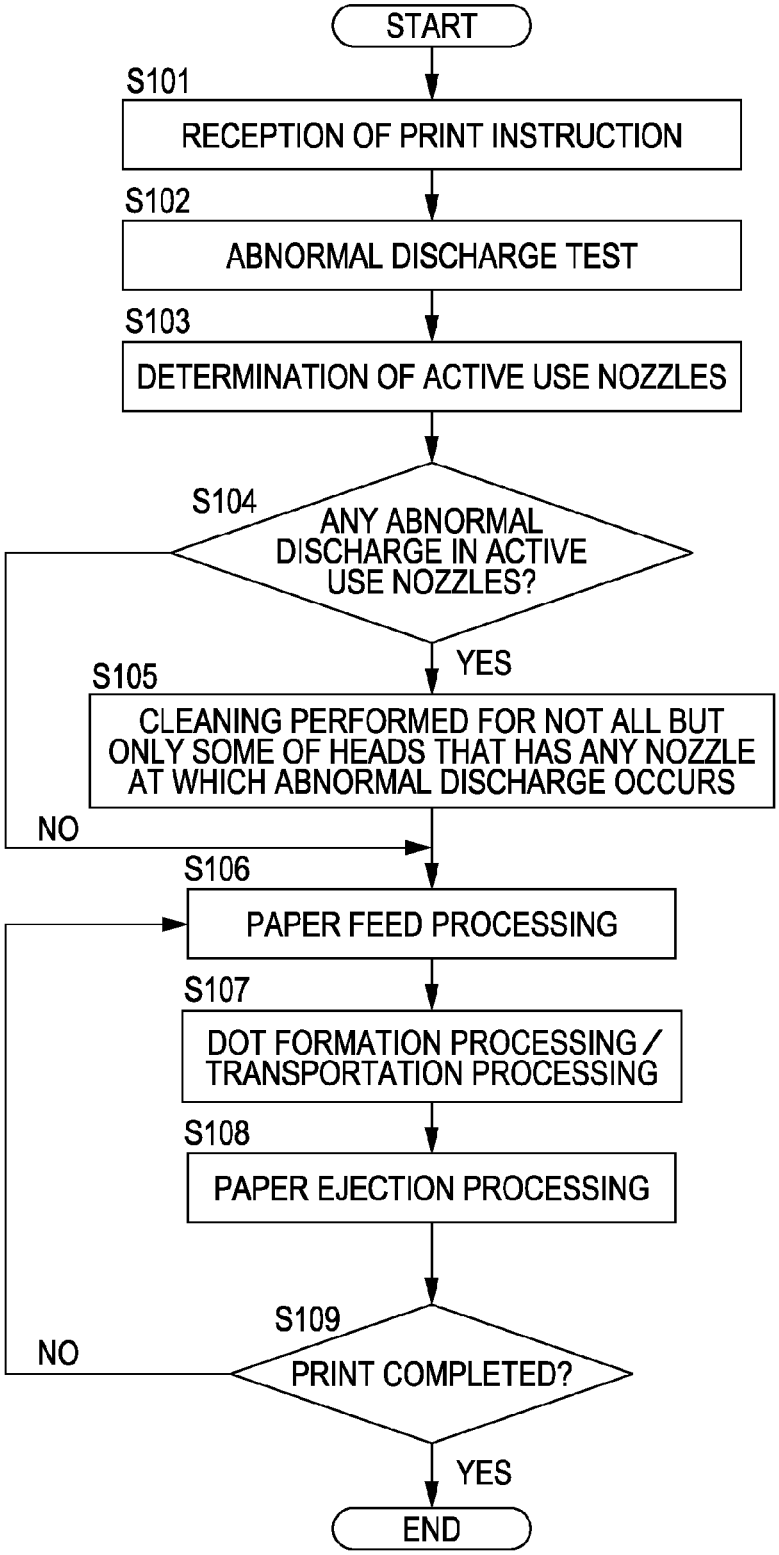
FIG. 20 is a flowchart that shows the flow of print processing according to another embodiment of the invention.

FIG. 20 is a flowchart that shows the flow of print processing according to the present embodiment of the invention. Each of processing steps described below is executed through the functioning of the controller 10, which controls each unit in accordance with a program stored in the memory 13. The program contains codes for execution of respective processing steps.

Print Command Reception (S101): Firstly, the controller 10 receives a printing instruction from the computer 50 via the interface section 11. Further explanation on this processing step is omitted here because it is the same as the step 5001 described above (refer to FIG. 5).

Abnormal Discharge Test (S102): The controller 10 carries out the abnormal discharge inspection on all nozzles. In the test, the controller 10 makes a judgment, for each of the nozzles, as to whether it is a malfunctioning one at which abnormal discharge occurs or not. In contrast to the aforementioned step 5003 in which the abnormal discharge test is conducted on active nozzles only, the test is conducted on all nozzles in the present embodiment of the invention. In addition, in contrast to the aforementioned step 5003 in which a judgment is made also on the presence/absence of the abnormal discharge in the active nozzles, a judgment is made only as to whether the tested nozzle is a malfunctioning one or not in this embodiment of the invention. Further explanation on the method of the abnormal discharge test is omitted here because it is the same as that explained in the aforementioned embodiment.

Determination of Active Use Nozzle(s) (S103): On the basis of the print data, the controller 10 makes determination, for each of the nozzles, as to whether ink is to be discharged or not from the nozzle of the head unit 31. That is, through this determination step, "active (use) nozzles", which are required to be activated for completion of a print image, are selected. Further explanation on this processing step is omitted here because it is the same as the step 5002 described above.

Judgment of Necessity of Cleaning (S104): The controller 10 makes a judgment, for each of the "active nozzles", as to whether it is a malfunctioning one at which abnormal discharge occurs or not. Cleaning is performed if there are some malfunctioning nozzles among the active use nozzles. Cleaning is skipped if there is not any malfunctioning nozzle among the active use nozzles. Even if a plurality of malfunctioning nozzles is detected in the step S102, cleaning is skipped if all of the malfunctioning nozzles are "inactive nozzles".

Cleaning (S105): The controller 10 carries out cleaning on not all, but only some of head(s) that has any malfunctioning nozzle(s) among the "active nozzles". Further explanation on this processing step is omitted here because it is the same as the step 5004 described above.

Paper-feed Processing and Subsequent Steps (S106-S109): Explanation on the paper-feed processing and the subsequent steps is omitted here because they are the same as the steps S005-S008 described above.

In the present embodiment of the invention, even if any malfunctioning nozzle is detected, cleaning is skipped if the detected malfunctioning nozzle(s) is an "inactive nozzle(s)". Therefore, it is possible to reduce the number of times of cleaning and/or the number of heads to be cleaned so as to shorten cleaning time also in this embodiment of the invention. It should be noted that, if a plurality of malfunctioning nozzles is detected, cleaning is conducted if any one of the malfunctioning nozzles is an "active nozzle", whereas cleaning is skipped if all of the malfunctioning nozzles are "inactive nozzles". By this means, it is possible to shorten cleaning time while ensuring that a printed image is not affected at all.

In this embodiment of the invention, the controller 10 carries out cleaning on not all, but only some of head(s) that has any malfunctioning nozzle(s) among the "active nozzles". In other words, the controller 10 conducts cleaning on malfunctioning nozzles that are used as "active nozzles" only. For example, it is assumed here that the nozzle #7 of the cyan ink nozzle line C(2) of the head (2) and the nozzle #7 of the cyan ink nozzle line C(1) of the head (1), each of which is denoted by a cross mark in FIG. 6, are detected as malfunctioning nozzles. In this case, the controller 10 conducts cleaning on the head (2) only, which means that cleaning is skipped for the head (1). By this means, it is possible to shorten cleaning time.

In addition, if it is assumed that the line head printer according to the present embodiment of the invention has the configurations illustrated in FIGS. 7 and 8, a pump suction apparatus is provided at a position opposing to each head in the same manner as in the aforementioned embodiment. In such a configuration, a belt is provided between the pump suction apparatus and the head. In order to prevent the belt from the possible landing of any ink thereon that is discharged from the head at the time of abnormal discharge test and/or at the time of cleaning, four openings 24 each of which corresponds to a head (refer to FIG. 7) are provided in the belt. Likewise the aforementioned embodiment, in the present embodiment of the invention, the positions of these four openings 24 (refer to FIG. 7) are different from those of four heads 31 in the head unit (refer to FIG. 4). Each of the openings 24 is provided at a position that is the same as that of a corresponding head 31 when viewed in the direction of the width of the paper; however, none of these openings 24 overlaps each other when viewed in the direction of transportation. If these four openings are arranged in such a pattern, when one head is opposed to a corresponding opening, other heads are not opposed to respective openings. Therefore, because it is not possible to conduct cleaning operations on two or more heads at the same time, cleaning is performed on one head at a time when there is a need for cleaning two or more heads. Advantageously, however, as the belt 22 has the openings 24 in such an arrangement pattern, the strength of the belt 22 is maintained.

Other Embodiment 3

Although each of the above embodiments describes a printing system that has mainly an ink-jet type printer, these descriptions contain the disclosure of the abnormal discharge test, cleaning, among other disclosures. In addition, the embodiments described above are provided solely for the purpose of facilitating the understanding of the invention. It should be noted that, in no case, the above embodiments are interpreted to limit the scope of the invention. The invention may be modified or improved without departing from the spirit thereof; and in addition, it goes without saying that the scope of the invention encompasses various equivalents thereof. In particular, it is intended that the following specific embodiments are also within the scope of the invention.

Configuration of Line Head Printer

Although the basic configurations of a line head printer are explained in the embodiments described above, the configuration of the line head printer does not necessarily have to be the same as those described above. For example, the number of heads that the head unit has may not be four. As another example, although a paper is fed by a belt conveyor system according to the above embodiments, it may be configured that the paper wraps around the platen for feeding thereof.

Abnormal Discharge Test Method

Although the embodiments described above take an abnormal discharge test method that utilizes a laser as an example for explanation, the invention is not limited thereto. As an example of alternative methods, a sensing section that is made of a conductor is provided under the nozzle surface so that, when charged ink is discharged toward the sensing section, the presence/absence of discharged ink is judged on the basis of an induced current that is generated at that time. As another example of alternative methods, a diaphragm, which becomes deformed in accordance with a pressure change in the pressure chamber, and electrodes that are arranged to be opposed to the diaphragm are provided in the pressure chamber. In such another alternative method, the diaphragm and electrodes make up a capacitor so that any abnormal discharge is detected on the basis of an electrostatic capacitance change due to the vibration of the diaphragm.

Cleaning Method

Although a method for performing cleaning for each head is taken as an example in the embodiments described above, the invention is not limited to the method described above. For example, if flushing operations only are conducted without conducting pump suction operations, it is possible to carry out cleaning by forcibly discharging ink from malfunctioning nozzle(s) only. It is possible to reduce the amount of ink that is used for cleaning by conducting it on malfunctioning nozzle(s) only.

Although a flushing method and a pump suction method is taken as an example of a method for cleaning any malfunctioning nozzle(s) at which abnormal discharge occurs in the embodiments described above, the invention is not limited to the methods described above. For example, a method of removing paper dust, etc., by brushing the nozzle surface by means of a rubber wiper, etc., may be adopted. In addition, it is not necessary to have all components of the pump suction apparatus explained in the aforementioned embodiments. That is, it is sufficient if the apparatus is provided with a cap only. If a printing apparatus is provided with at least a cap, the apparatus is not stained by any drain ink discharged from malfunctioning nozzles.

Figure 17:
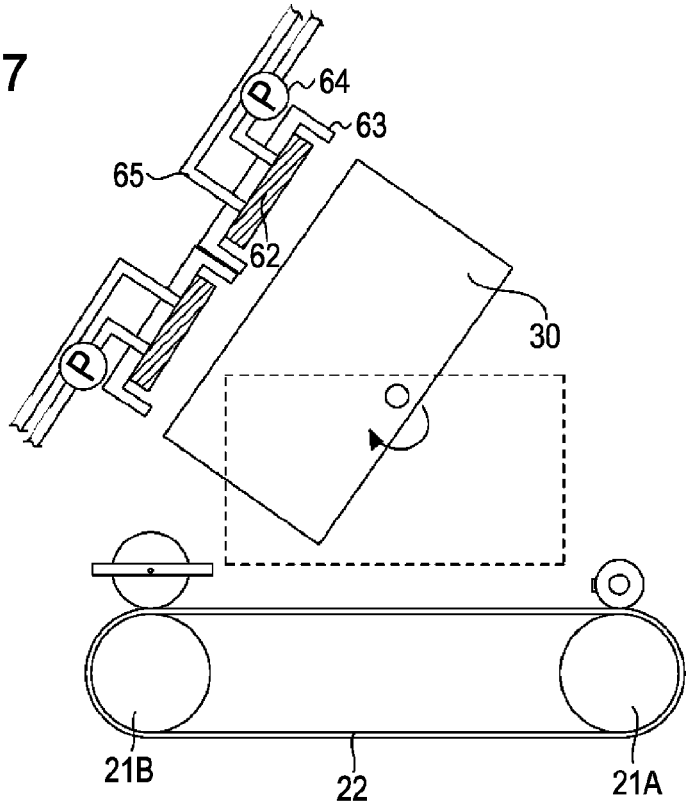
FIG. 17 is a diagram that illustrates a cleaning method adopted in a case where the pump suction apparatus is provided above the head unit.

Although a configuration in which a pump suction apparatus is positioned under a head unit (refer to FIG. 8) is taken as an example according to a line head printer discussed in the embodiments described above, the invention is not limited to the configuration described above. As an example of alternative configurations, a head-unit-turn mechanism may be provided, where a pump suction apparatus is positioned above a head unit, and the head unit is turned by the mechanism (refer to FIG. 17). In such a configuration, in order to conduct cleaning operations, the head unit is turned so that the nozzle surface is opposed to the pump suction apparatus.

Figure 18:
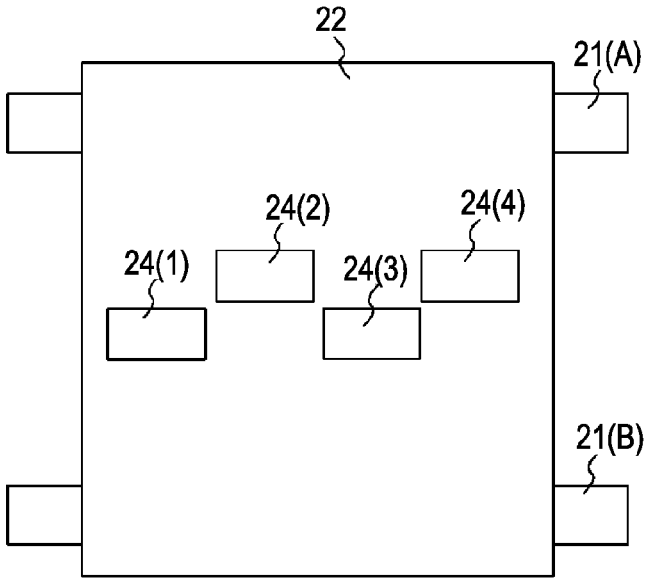
FIG. 18 is a diagram that illustrates an example of the arrangement pattern of openings in the belt.
Figure 19:
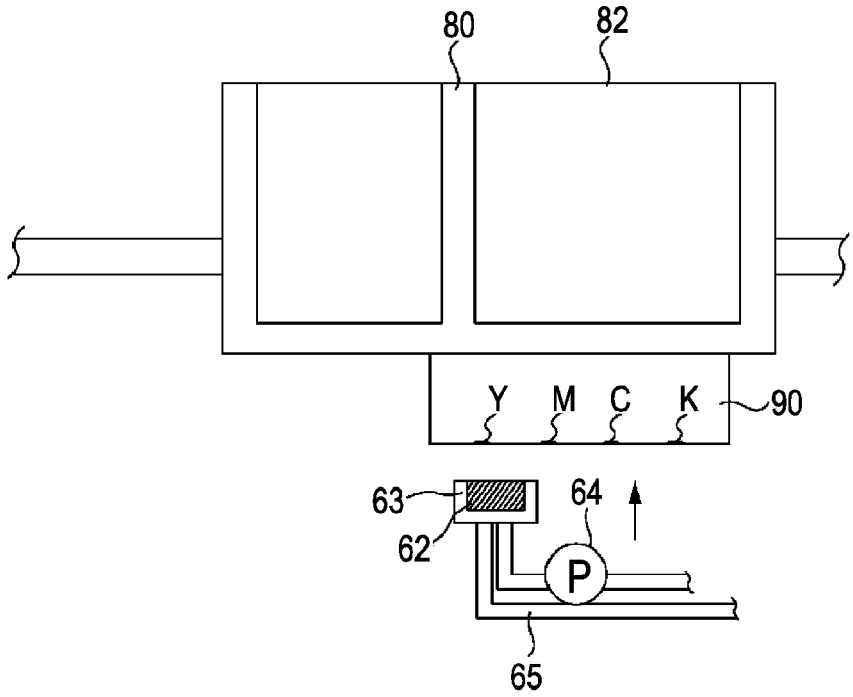
FIG. 19 illustrates an example of a downsized pump suction apparatus.

According to a line head printer of the embodiments described above, an opening is provided in the belt so that the pump suction apparatus contacts the head. As a specific manner of providing the openings therein, a hole-arrangement pattern that is not the same as the arrangement pattern of four of the heads 31 in the head unit (refer to FIG. 7) is taken as an example. However, the invention is not limited to the arrangement pattern described above. For example, openings may be arranged at the same positions as those of four heads 31 in the head unit (refer to FIG. 18). With such an arrangement pattern, it is possible to avoid the trouble of having to align the position of a head and a corresponding opening by rotating the belt in order to perform an abnormal discharge test and cleaning for the next head after completion of an abnormal discharge test and cleaning for one head. In addition thereto, it becomes possible to perform cleaning for all heads at a time. However, the strength of the belt decreases if openings are provided in an arrangement pattern illustrated in FIG. 18.

Although a pump suction apparatus having a size that matches the size of a head (refer to FIG. 16) is taken as an example of a pump suction apparatus for a carriage-type printer in the embodiments described above, the invention is not limited thereto. For example, the size of the pump suction apparatus may be made smaller so that cleaning can be performed for each nozzle line. With such a configuration, it is possible to reduce the amount of avoidable drain ink discharged from any nozzle line(s) that does not have any malfunctioning nozzle at the time of pump suction operations. However, a mechanism for moving the pump suction apparatus in the direction of move is required for such a configuration. In addition thereto, it takes extra time for cleaning because pump suction is performed for each nozzle line when there is a plurality of nozzle lines that has malfunctioning nozzle(s).

Timing at which Abnormal Discharge Test and Cleaning are Performed

Although it is explained in the embodiments described above that cleaning is performed after completion of a process of an abnormal discharge test, the invention is not limited thereto. For example, when any malfunctioning nozzle(s) is detected by carrying out an abnormal discharge test on a head having "active nozzles", the head for which the malfunctioning nozzle is detected may be cleaned before the abnormal discharge test is performed on the next head. With such a modification, it is possible to avoid the trouble of having to align the position of a head and a corresponding opening of the belt again in order to clean the head for which the malfunctioning nozzle is detected after completion of the abnormal discharge test on all of the heads having the "active nozzles".

Although it is explained in the embodiments described above that an abnormal discharge test is performed when a printing instruction for a different image is received (refer to FIG. 5), the invention is not limited thereto. For example, an abnormal discharge test may be performed before starting printing for each of the print target papers.

In addition thereto, if the printer is a carriage-type one, an abnormal discharge test may be performed at each one execution of carriage move (scan). In such a case, a determination is made as to whether each nozzle is an "active nozzle" or an "inactive nozzle" for each scan to perform an abnormal discharge test.

Black and White Printing

According to the embodiments described above, the controller makes determination, on the basis of the pixel data, as to whether each of nozzles is an "active nozzle" or an "inactive nozzle". In the case of black and white printing, firstly, the controller determines that the nozzles in the black ink nozzle line are "active nozzles", whereas it determines that the nozzles in the cyan ink nozzle line, the magenta ink nozzle line, and the yellow ink nozzle line are "inactive nozzles". Subsequently, the controller makes determination, on the basis of the pixel data, as to whether each of the nozzles in the black ink nozzle line is an "active nozzle" or an "inactive nozzle".

Ink

As an ink-jet type printer is assumed in the embodiments described above, dye ink or pigment-based ink in the form of a liquid is discharged from nozzles. However, the invention is not limited thereto. That is, as long as it is in the form of a liquid, it is possible to be discharged from the nozzles.

Printer

Although the invention is explained on a printer in the embodiments described above, the invention is not limited thereto. For example, the same technique as that described in the above embodiments may be applied to various kinds of liquid discharging apparatuses to which an ink-jet technique is applied, including but not limited to, a color filter manufacturing apparatus, a dyeing apparatus, a micromachining apparatus, a semiconductor manufacturing apparatus, a surface treatment apparatus, a 3D modeling apparatus, a liquid gasification apparatus, an organic EL manufacturing apparatus (in particular, a macromolecular EL manufacturing apparatus), a display manufacturing apparatus, a film deposition apparatus, and a DNA chip manufacturing apparatus.

Nozzle

Ink is discharged by means of a piezoelectric element in the embodiments described above. However, a liquid discharging method of the invention is not limited thereto. For example, other methods may be adopted, which include without any limitation thereto, a method of generating bubbles in nozzles due to heat.

The invention claimed is:

1. A liquid drop discharging apparatus comprising:

a plurality of nozzles that discharge liquid drops;

a sensor that detects a malfunctioning nozzle at which abnormal discharge occurs when a liquid drop is supposed to be discharged therefrom;

a controller that determines whether a liquid drop is discharged or not from each of the nozzles on the basis of image data, the controller causing the sensor to detect the malfunctioning nozzle among the nozzles that are determined to discharge liquid drops on the basis of the image data;

a restoration mechanism used for restoration processing performed on the malfunctioning nozzle so that the restored nozzle discharges ink properly, wherein the controller performs the restoration processing when the sensor detects the malfunctioning nozzle; and a transporting mechanism that transports a target object on which liquid drops discharged from the plurality of nozzles land by means of a belt in a direction which is perpendicular to a predetermined direction in which the plurality of nozzles are arranged in the plurality of heads, wherein the restoration mechanism is provided at a position where the restoration mechanism can be opposed to nozzle surfaces of the plurality of heads in such a manner that the belt is positioned between the restoration mechanism and the plurality of heads, wherein the belt has openings arranged such that only one of the plurality of heads is opposed to a corresponding opening at a single time, the number openings being the same as the number of the plurality of heads.

2. The liquid drop discharging apparatus according to claim 1, wherein the sensor tests whether the nozzle is a malfunctioning one or not on a nozzle-by-nozzle basis if the number of the nozzles that are determined to discharge liquid drops on the basis of the image data is more than one.

3. The liquid drop discharging apparatus according to claim 1, wherein the sensor detects liquid drops discharged from the nozzles.

4. The liquid drop discharging apparatus according to claim 1, wherein the restoration processing is a processing to discharge a liquid drop from the malfunctioning nozzle.

5. The liquid drop discharging apparatus according to claim 1, wherein the controller performs the restoration processing on the detected malfunctioning nozzle only when the sensor detects the malfunctioning nozzle.

6. The liquid drop discharging apparatus according to claim 1, further comprising a transporting mechanism that transports a target object, which liquid drops discharged from the plurality of nozzles land on, in a direction perpendicular to a predetermined direction with respect to a plurality of heads, wherein the plurality of nozzles are provided in the plurality of heads that are arranged in the predetermined direction.

7. The liquid drop discharging apparatus according to claim 1, further comprising a transporting mechanism that transports a target object, which liquid drops discharged from the plurality of nozzles land on, in a direction perpendicular to a predetermined direction with respect to a plurality of heads, wherein the plurality of nozzles are provided in the plurality of heads that are arranged in the predetermined direction, and the controller performs the restoration processing on, exclusively, the heads that are provided with the detected malfunctioning nozzle when the sensor detects the malfunctioning nozzle.

8. A liquid discharging apparatus comprising:

a plurality of nozzles that discharge liquid drops;

a sensor that detects a malfunctioning nozzle at which abnormal discharge occurs; and a controller that determines whether a liquid drop is discharged or not from each of the nozzles on the basis of image data, a restoration mechanism used for performing restoration processing on the malfunctioning nozzle so that the malfunctioning nozzle discharges ink properly, a transporting mechanism that transports a target object on which liquid drops discharged from the plurality of nozzles land by means of a belt in a direction which is perpendicular to a predetermined direction in which the plurality of nozzles are arranged in the plurality of heads, wherein the restoration mechanism is provided at a position where the restoration mechanism can be opposed to nozzle surfaces of the plurality of heads in such a manner that the belt is positioned between the restoration mechanism and the plurality of heads, wherein the belt has openings arranged such that only one of the plurality of heads is opposed to a corresponding opening at a single time, the number openings being the same as the number of the plurality of heads, wherein, when the malfunctioning nozzle is detected by the sensor, the controller causes a liquid drop to be discharged on the basis of the image data if the detected malfunctioning nozzle is the nozzle that is determined not to discharge the liquid drop on the basis of the image data, and wherein, when a plurality of the malfunctioning nozzles are detected by the sensor, the controller causes the restoration processing to be performed if the detected malfunctioning nozzles are the nozzles that are determined to discharge ink drops on the basis of the image data, whereas the controller causes liquid drops to be discharged on the basis of the image data without performing the restoration processing if the detected malfunctioning nozzles are the nozzles that are determined not to discharge liquid drops on the basis of the image data.

9. The liquid discharging apparatus according to claim 8, wherein, when the restoration processing is performed, the controller performs the restoration processing on the malfunctioning nozzles that are determined to discharge the liquid on the basis of the image data.

10. A liquid discharging method for discharging liquid drops from a plurality of nozzles on the basis of image data, the method comprising:

a step of determining whether a liquid drop is discharged or not from each of the nozzles on the basis of the image data; and a step of detecting a malfunctioning nozzle at which abnormal discharge occurs when a liquid drop is supposed to be discharged therefrom among the nozzles that are determined to discharge liquid drops on the basis of the image data;

a step of performing restoration processing on the malfunctioning nozzle when the sensor detects the malfunctioning nozzle using a restoration mechanism so that the restored nozzle discharges ink properly; and a step of transporting a target object on which liquid drops discharged from the plurality of nozzles land by means of a transportation mechanism including a belt which is disposed in a direction which is perpendicular to a predetermined direction in which the plurality of nozzles are arranged in the plurality of heads, wherein the restoration mechanism is provided at a position where the restoration mechanism can be opposed to nozzle surfaces of the plurality of heads in such a manner that the belt is positioned between the restoration mechanism and the plurality of heads, wherein the belt has openings arranged such that only one of the plurality of heads is opposed to a corresponding opening at a single time, the number openings being the same as the number of the plurality of heads.

11. A liquid discharging method for discharging liquid drops from a plurality of nozzles on the basis of image data, the method comprising:

a step of detecting a malfunctioning nozzle at which abnormal discharge occurs;

a step of determining whether a liquid drop is discharged or not from each of the nozzles on the basis of the image data; and a step of discharging a liquid drop on the basis of the image data if the detected malfunctioning nozzle is the nozzle that is determined not to discharge a liquid drop on the basis of the image data when the malfunctioning nozzle is detected a step of performing restoration processing on the malfunctioning nozzle when the sensor detects the malfunctioning nozzle using a restoration mechanism so that the restored nozzle discharges ink properly; and a step of transporting a target object on which liquid drops discharged from the plurality of nozzles land by means of a transportation mechanism including a belt which is disposed in a direction which is perpendicular to a predetermined direction in which the plurality of nozzles are arranged in the plurality of heads, wherein the restoration mechanism is provided at a position where the restoration mechanism can be opposed to nozzle surfaces of the plurality of heads in such a manner that the belt is positioned between the restoration mechanism and the plurality of heads, wherein the belt has openings arranged such that only one of the plurality of heads is opposed to a corresponding opening at a single time, the number openings being the same as the number of the plurality of heads, and wherein, when a plurality of the malfunctioning nozzles are detected by the sensor, the restoration processing is performed if the detected malfunctioning nozzles are the nozzles that are determined to discharge ink drops on the basis of the image data, whereas liquid drops are discharged on the basis of the image data without performing the restoration processing if the detected malfunctioning nozzles are the nozzles that are determined not to discharge liquid drops on the basis of the image data.

* * * * *